US009599917B2

(12) United States Patent
Okuda et al.

(10) Patent No.: US 9,599,917 B2
(45) Date of Patent: Mar. 21, 2017

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Atsushi Okuda, Yokohama (JP); Nobuhiro Nakamura, Numazu (JP); Kazunori Noguchi, Suntou-gun (JP); Akihiro Maruyama, Mishima (JP); Atsushi Fujii, Yokohama (JP); Yuka Ishiduka, Suntou-gun (JP); Yuki Yamamoto, Tokyo (JP); Kazuko Sakuma, Suntou-gun (JP); Tatsuya Ikezue, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/971,156

(22) Filed: Dec. 16, 2015

(65) Prior Publication Data

US 2016/0187794 A1 Jun. 30, 2016

(30) Foreign Application Priority Data

Dec. 26, 2014 (JP) ..... 2014-266493
Jun. 10, 2015 (JP) ..... 2015-117435
Dec. 3, 2015 (JP) ..... 2015-236559

(51) Int. Cl.
*G03G 5/14* (2006.01)
*G03G 5/05* (2006.01)

(52) U.S. Cl.
CPC ..... *G03G 5/144* (2013.01); *G03G 5/0567* (2013.01); *G03G 5/142* (2013.01)

(58) Field of Classification Search
CPC ..... G03G 5/14; G03G 5/142; G03G 5/144
See application file for complete search history.

(56) References Cited

U.S. PATENT DOCUMENTS 6,268,095 B1 7/2001 Kuroda
6,815,135 B2 11/2004 Morikawa et al.
(Continued)

FOREIGN PATENT DOCUMENTS

JP 59-184359 A 10/1984
JP 2002-107986 A 4/2002
(Continued)

OTHER PUBLICATIONS

Yamashita, et al., "Crosslinking Agent Handbook", 1981, pp. 536-605.

(Continued)

*Primary Examiner* — Peter Vajda
(74) *Attorney, Agent, or Firm* — Fitzpatrick, Cella, Harper & Scinto

(57) ABSTRACT

An electrophotographic photosensitive member that abuts with a charging member and/or a developer carrying member with an abutting member interposed therebetween, wherein the electrophotographic photosensitive member has a first portion and a second portion abutting with the abutting member along the longitudinal direction thereof, the electrophotographic photosensitive member has a support, a charge generation layer containing a charge generating material and a polyacetal resin, and a surface layer in this order, the electrophotographic photosensitive member has, in the first portion, an undercoat layer containing a polymerized product of a composition including an electron transporting material and a cross-linking agent, the layer being adjacent to a surface of the charge generation layer, facing the support, and the electrophotographic photosensitive member has, in the second portion, an intermediate layer (Continued)

containing a metal oxide particle and a phenol resin, the layer being between and adjacent to the support and the charge generation layer.

6 Claims, 2 Drawing Sheets

(56) References Cited

U.S. PATENT DOCUMENTS

| | | | | |
|---|---|---|---|---|
| 8,088,541 | B2 | 1/2012 | Tanaka et al. | |
| 8,921,020 | B2 | 12/2014 | Morai et al. | |
| 8,940,465 | B2 | 1/2015 | Sekido et al. | |
| 2006/0188803 | A1* | 8/2006 | Yabuki ..... | G03G 5/08<br>430/118.7 |

FOREIGN PATENT DOCUMENTS

| | | | |
|---|---|---|---|
| JP | 3717320 | B2 | 11/2005 |
| JP | 2014-29480 | A | 2/2014 |

OTHER PUBLICATIONS

Yamamoto, et al., U.S. Appl. No. 14/941,537, filed Nov. 13, 2015.

* cited by examiner

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present invention relates to an electrophotographic photosensitive member, a process cartridge and an electrophotographic apparatus.

Description of the Related Art

An electrophotographic photosensitive member is mounted on a process cartridge or an electrophotographic apparatus. For the purpose of an enhancement in the quality of an image to be obtained by an electrophotographic image recording method, a method involving providing, in an electrophotographic photosensitive member, an undercoat layer containing a polymerized product of a composition including an electron transporting material and a cross-linking agent is known (Japanese Patent Application Laid-Open No. 2014-029480). Japanese Patent Application Laid-Open No. 2014-029480 describes the following: such a configuration can allow the occurrence of a positive ghost to be suppressed. Herein, the positive ghost is a phenomenon where only a region of an image output irradiated with light in pre-rotation of an electrophotographic photosensitive member has a high density, and is one technical problem of deterioration in the quality of an image to be obtained.

SUMMARY OF THE INVENTION

The present invention is directed to providing an electrophotographic photosensitive member that abuts with at least any member selected from the group consisting of a charging member that charges the electrophotographic photosensitive member and a developer carrying member that feeds a developer to the electrophotographic photosensitive member, with an abutting member interposed therebetween, wherein the electrophotographic photosensitive member has a first portion and a second portion different from the first portion along the longitudinal direction thereof, and abuts with the abutting member on the second portion, the electrophotographic photosensitive member has a support, a charge generation layer containing a charge generating material and a polyacetal resin, and a surface layer in this order, the electrophotographic photosensitive member has, in the first portion, an undercoat layer containing a polymerized product of a composition including an electron transporting material and a cross-linking agent, the undercoat layer being adjacent to a surface of the charge generation layer, and the surface facing the support, and the electrophotographic photosensitive member has, in the second portion, an intermediate layer containing a metal oxide particle and a phenol resin, the layer being between and adjacent to the support and the charge generation layer.

The present invention can provide an electrophotographic photosensitive member in which layer peeling-off is suppressed at an end portion abutting with an abutting member, as well as a process cartridge and an electrophotographic apparatus using the electrophotographic photosensitive member.

Further features of the present invention will become apparent from the following description of exemplary embodiments with reference to the attached drawings.

DESCRIPTION OF THE EMBODIMENTS

Figure 1A:
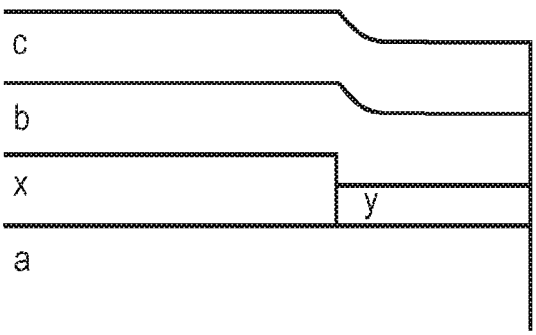
FIGS. 1A and 1B are views illustrating one example of a layer configuration of the electrophotographic photosensitive member of the present invention.

Preferred embodiments of the present invention will now be described in detail in accordance with the accompanying drawings.

A charging unit, an exposing unit, a developing unit, a transfer unit, a cleaning unit and the like are provided around an electrophotographic photosensitive member, and an image is formed through steps by use of such units. In particular, a charging member that charges the electrophotographic photosensitive member, and a developer carrying member that feeds a developer to the electrophotographic photosensitive member abut with an end portion of the electrophotographic photosensitive member, with an abutting member such as a gap holding member interposed therebetween. The electrophotographic photosensitive member is subjected to large stress at such an abutting portion, and therefore the repeated use thereof for a long period may cause layer peeling-off in the electrophotographic photosensitive member at the abutting portion. In particular, as in Japanese Patent Application Laid-Open No. 2014-029480, when an undercoat layer containing a polymerized product of a composition including an electron transporting material and a cross-linking agent is adjacent to and provided below a charge generation layer containing a charge generating material, peeling-off may be remarkably caused at the interface between the undercoat layer and the charge generation layer.

Then, a method involving providing an undercoat layer only in an image formation region of an electrophotographic photosensitive member, namely, a method involving providing no undercoat layer at an end portion of an electrophotographic photosensitive member abutting with an abutting member, has been studied, but layer peeling-off in the electrophotographic photosensitive member at such an abutting portion has been caused.

Accordingly, an object of the present invention is to provide an electrophotographic photosensitive member in which layer peeling-off is suppressed at an end portion abutting with an abutting member even in the case where an undercoat layer is provided for an enhancement in image quality, as well as a process cartridge and an electrophotographic apparatus using the electrophotographic photosensitive member.

Hereinafter, the present invention is described in detail with reference to exemplary embodiments.

The present inventors have made studies about a position at which layer peeling-off is caused in the case where no undercoat layer is provided at an end portion (abutting portion) of an electrophotographic photosensitive member, abutting with an abutting member, and as a result, have found that peeling-off of a charge generation layer is easily caused at an end portion (in the vicinity of the boundary between an image formation region and the abutting portion)

of an undercoat layer. Then, the present inventors have found that an intermediate layer can be provided so as to be between and adjacent to a support at the abutting portion and a charge generation layer, and the charge generation layer and the intermediate layer can each contain a specific resin so as to be bound to each other, thereby resulting in an enhancement in adhesiveness between the layers to allow peeling-off of the undercoat layer at the end portion to be suppressed.

The electrophotographic photosensitive member of the present invention has a support, a charge generation layer containing a charge generating material and a polyacetal resin, and a surface layer in this order. The electrophotographic photosensitive member has a first portion that is an image formation region, and a second portion that is different from the first portion and that is a region including a surface abutting with a gap holding member, along the longitudinal direction thereof. Here, the electrophotographic photosensitive member has, in the first portion, an undercoat layer containing a polymerized product of a composition including an electron transporting material and a cross-linking agent, the undercoat layer being adjacent to a surface of the charge generation layer, and the surface facing the support, and furthermore has, in the second portion, an intermediate layer containing a metal oxide particle and a phenol resin, the layer being between and adjacent to the support and the charge generation layer.

Figure 1B:
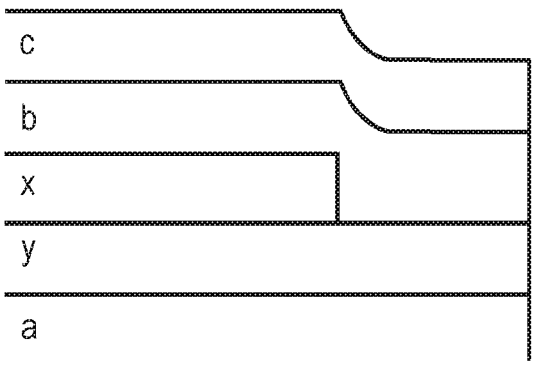

More specifically, as illustrated in FIGS. 1A and 1B, a configuration is adopted in which the first portion of the electrophotographic photosensitive member has a support a, an undercoat layer x, a charge generation layer b and a surface layer c in this order, and the second portion of the electrophotographic photosensitive member has a support a, an intermediate layer y, a charge generation layer b and a surface layer c in this order.

The electrophotographic photosensitive member may have the intermediate layer (A) only in the second portion (in FIG. 1A) or (B) continuously from the second portion to the first portion (in FIG. 1B). Both such cases allow the effect of suppressing layer peeling-off, which is the effect of the present invention, to be exerted, and the case in (B) can be adopted.

Arrangement of the undercoat layer x in the first portion in each of the cases (A) and (B) is as follows.

(A) The undercoat layer is provided so as to be between and adjacent to the support a and the charge generation layer b.

(B) The undercoat layer is provided so as to be between and adjacent to the intermediate layer y and the charge generation layer b.

(Process Cartridge)

The process cartridge of the present invention is configured to be detachably attachable to the main body of an electrophotographic apparatus. The process cartridge of the present invention has an electrophotographic photosensitive member, and at least any selected from the group consisting of a charging member that charges the electrophotographic photosensitive member and a developer carrying member that feeds a developer to the electrophotographic photosensitive member. Furthermore, the charging member and/or the developer carrying member has an abutting member such as a gap holding member that holds a gap with the electrophotographic photosensitive member. Furthermore, the process cartridge may have a transfer member and a cleaning member.

<Electrophotographic Photosensitive Member>

The electrophotographic photosensitive member of the present invention has a support, a charge generation layer and a surface layer in this order. The surface of the first portion of the photosensitive member includes a region (image formation region) in which image formation can be performed, and the surface of the second portion of the photosensitive member includes a region abutting with an abutting member. The second portion can be an end portion of the photosensitive member. Such a configuration, namely, a configuration in which the photosensitive member abuts with the abutting member at the end portion thereof can be adopted to thereby ensure the image formation region as much as possible. The second portion can be provided at both ends of the photosensitive member, and can be provided within the range of 20 mm or less from each of the end portions of the photosensitive member in the longitudinal direction.

Examples of the method for producing the electrophotographic photosensitive member include a method including preparing respective coating liquids for layers, described below, performing coating of the coating liquids in the desired order of layers, and drying the resultant. Here, examples of the coating method of each of the coating liquids include a dip coating method, a spray coating method, a curtain coating method and a spin coating method. In particular, a dip coating method can be adopted in terms of efficiency and productivity.

Hereinafter, each of the layers is described in detail. Herein, the average thickness of each of the layers is determined by performing measurement by use of a thickness measuring meter Fischer MMS (eddy current probe EAW3.3) (manufactured by Fischer Instruments K.K.), and calculating the average of the thicknesses at 5 points. When the thickness is determined by the measurement to be 1 μm or less, the measurement is performed by use of an F20 thickness measurement system (manufactured by FILMETRICS), and the average of the thicknesses at 5 points is calculated.

(Support)

In the present invention, the support can be a conductive support having conductivity. Examples of the conductive support include a support formed by a metal such as aluminum, iron, nickel, copper or gold, or an alloy, and a support obtained by forming, on an insulating support such as a polyester resin, a polycarbonate resin, a polyimide resin or a glass, a thin film of a metal such as aluminum, chromium, silver or gold; a thin film of a conductive material such as indium oxide, tin oxide or zinc oxide; or a thin film of a conductive ink to which a silver nanowire is added.

The surface of the support may be subjected to an electrochemical treatment such as anode oxidization, a wet honing treatment, a blast treatment, a cutting treatment or the like for the purposes of an improvement in electric properties and suppression of interference fringes.

(Conductive Layer)

In the present invention, a conductive layer may also be provided on the support. The conductive layer can contain a metal oxide particle.

The conductive layer can be formed by preparing a coating liquid for a conductive layer, and coating the support with the coating liquid. The coating liquid for a conductive layer can contain a solvent together with the metal oxide particle. Examples of such a solvent include an alcohol type solvent, a sulfoxide type solvent, a ketone type solvent, an ether type solvent, an ester type solvent or an aromatic hydrocarbon solvent. Examples of the method for dispersing the metal oxide particle in the coating liquid for a conductive layer include a method using a paint shaker, a sand mill, a ball mill or a liquid collision type high-speed disperser. In order to enhance dispersibility of the metal oxide particle, the surface of the metal oxide particle may also be treated with a silane coupling agent or the like. Furthermore, in order to control resistivity of the conductive layer, the metal oxide particle may also be doped with other metal or metal oxide.

Examples of the metal oxide particle include zinc oxide, white lead, aluminum oxide, indium oxide, silicon oxide, zirconium oxide, tin oxide, titanium oxide, magnesium oxide, antimony oxide, bismuth oxide, tin-doped indium oxide, antimony or tantalum-doped tin oxide and zirconium oxide particles. In particular, zinc oxide, titanium oxide and tin oxide particles can be adopted.

The number average particle size of the metal oxide particle is preferably 30 to 450 nm, more preferably 30 to 250 nm in order to suppress the occurrence of a black point due to formation of a local conductive path.

The conductive layer can further contain a resin particle having an average particle size of 1 μm or more and 5 μm or less. Such a configuration can suppress the following: the surface of the conductive layer is roughened and light reflected on the surface of the conductive layer interferes to cause interference fringes on an image output. Examples of the resin particle include thermosetting resin particles such as curable rubber, polyurethane, epoxy resin, alkyd resin, phenol resin, polyester, silicone resin and acryl-melamine resin particles. In particular, a silicone resin particle that hardly aggregates can be adopted.

The average thickness of the conductive layer is preferably 2 μm or more and 40 μm or less, more preferably 10 μm or more and 30 μm or less.

The ten-point average roughness $Rz_{JIS}$ (standard length: 0.8 mm) of the surface of the conductive layer according to JIS B 0601:2001 can be 0.5 μm or more and 2.5 μm or less.

(Charge Generation Layer)

In the present invention, the charge generation layer contains a charge generating material and a polyacetal resin. Furthermore, in the first portion of the electrophotographic photosensitive member, the charge generation layer is adjacent to an undercoat layer described below, on a surface facing the support (surface opposite to a surface facing the surface layer).

As the charge generating material, a conventionally known material can be used. Specifically, examples include an azo pigment, a perylene pigment, an anthraquinone derivative, an anthanthrone derivative, a dibenzpyrenequinone derivative, a pyranthrone derivative, a violanthrone derivative, an isoviolanthrone derivative, an indigo derivative, a thioindigo derivative, a phthalocyanine pigment such as a metal phthalocyanine and a metal-free phthalocyanine, and a bisbenzimidazole derivative. In particular, an azo pigment or a phthalocyanine pigment can be adopted. As the phthalocyanine pigment, in particular, an oxytitanium phthalocyanine, a chlorogallium phthalocyanine or a hydroxygallium phthalocyanine can be adopted.

The polyacetal resin can be a resin having a structural unit represented by the following general formula (I) and having a structural unit represented by the following general formula (II).

(I)

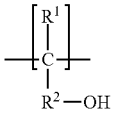

-continued (II)

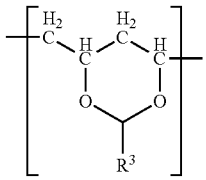

In the general formula (I), $R^1$ represents a hydrogen atom or an alkyl group. $R^2$ represents a single bond or a phenylene group. In the general formula (II), $R^3$ represents an alkyl group, an aryl group or a hydrogen atom. The alkyl group may be substituted with an alkyl group, an aryl group, a halogen atom or an alkoxycarbonyl group. The aryl group may be substituted with a halogen atom, a nitro group, a cyano group, an alkyl group, a halogen-substituted alkyl group or an alkoxy group.

Examples of a commercially available polyacetal resin include S-LEC Series such as BX-1, BM-1, KS-1 and KS-5 (all produced by Sekisui Chemical Co., Ltd.). The weight average molecular weight of the polyacetal resin can be 5,000 or more and 400,000 or less.

The content of the charge generating material in the charge generation layer is preferably 0.1 times or more and 10 times or less, more preferably 0.2 times or more and 5 times or less the content of the resin in terms of the mass ratio (the content of the charge generating material/the content of the resin).

The average thickness of the charge generation layer is preferably 0.05 μm or more and 5 μm or less, more preferably 0.1 μm or more and 1 μm or less.

In addition, the average thickness of the charge generation layer in the second portion (region abutting with the abutting member) can be less than the average thickness of the charge generation layer in the first portion (image formation region). Such a configuration can suppress a discharge phenomenon caused between the second portion (region abutting with the abutting member) of the photosensitive member and the charging member or the developer carrying member, and therefore wearing of the photosensitive member due to such a discharge phenomenon can be prevented.

The charge generation layer can be formed by preparation of a coating liquid for a charge generation layer and coating of the coating liquid. The coating liquid for a charge generation layer can contain a solvent together with the charge generating material. Examples of such a solvent include an alcohol type solvent, a sulfoxide type solvent, a ketone type solvent, an ether type solvent, an ester type solvent or an aromatic hydrocarbon solvent.

(Surface Layer)

In the present invention, the surface layer is a layer provided on the outermost surface of the electrophotographic photosensitive member. Specifically, the surface layer is a layer configured from only a charge transport layer, a layer configured from only a surface protective layer, or a layer configured from a charge transport layer and a surface protective layer. Hereinafter, the charge transport layer and the surface protective layer are described, respectively.

(1) Charge Transport Layer

In the present invention, the charge transport layer can contain a charge transporting material and a resin.

Examples of the charge transporting material include a polycyclic aromatic compound, a heterocyclic compound, a hydrazone compound, a styryl compound, a benzidine compound, a triarylamine compound and triphenylamine, and a polymer having a group derived from such a compound, as a main chain or a side chain. In particular, a triarylamine compound, a benzidine compound or a styryl compound can be used.

Examples of the resin include a polyester resin, a polycarbonate resin, a polymethacrylate resin, a polyarylate resin, a polysulfone resin and a polystyrene resin. In particular, a polycarbonate resin or a polyarylate resin can be used. The weight average molecular weight of the resin can be 10,000 or more and 300,000 or less.

The content of the charge transporting material in the charge transport layer is preferably 0.5 times or more and 2 times or less, more preferably 0.6 times or more and 1.25 times or less the content of the resin in terms of the mass ratio (the content of the charge transporting material/the content of the resin).

The average thickness of the charge transport layer is preferably 3 μm or more and 40 μm or less, more preferably 5 μm or more and 25 μm or less, particularly preferably 5 μm or more and 16 μm or less.

The charge transport layer can be formed by preparation of a coating liquid for a charge transport layer, and coating of the coating liquid. The coating liquid for a charge transport layer can contain a solvent together with the charge transporting material and the resin. Examples of such a solvent include an alcohol type solvent, a sulfoxide type solvent, a ketone type solvent, an ether type solvent, an ester type solvent or an aromatic hydrocarbon solvent.

(2) Surface Protective Layer

In the present invention, specific examples of the surface protective layer include one containing a conductive particle, a charge transporting material and a resin. Examples of the conductive particle include a metal oxide particle such as a tin oxide particle. The surface protective layer can further contain an additive such as a lubricant. When the resin has conductivity and charge transporting property by itself, the surface protective layer may not contain the conductive particle and the charge transporting material.

Other specific examples of the surface protective layer also include one containing a resin that is a cured product of a composition including a charge transporting compound. In such a case, examples of the charge transporting compound include a compound having a (meth) acryloyloxy group. Such a compound is irradiated with radiation such as an electron beam or a gamma beam for the occurrence of a polymerization reaction, and cured.

The thickness of the surface protective layer is preferably 0.1 μm or more and 20 μm or less, more preferably 1 μm or more and 10 μm or less.

In order to reduce a friction force to a cleaning member or the like, the surface protective layer may also have a specific surface shape. Examples include a surface shape on which a plurality of concave portions are formed, a surface shape on which a plurality of convex portions are formed, a surface shape on which a plurality of groove portions are formed, and a surface shape on which such portions are formed in combination. Such a surface shape can be formed by pressing and contacting a mold having a corresponding shape on and with the surface protective layer. Herein, even in the case where the mold is pressed and contacted, layer peeling-off may be caused, but the configuration of the electrophotographic photosensitive member of the present invention can allow layer peeling-off to be suppressed even in such a case.

(Undercoat Layer)

In the present invention, the undercoat layer contains a polymerized product of a composition including an electron transporting material and a cross-linking agent. Furthermore, a polymerized product of a composition including an electron transporting material, a cross-linking agent and a resin may also be adopted. In the composition, the mass ratio of the electron transporting material to the other materials (the cross-linking agent, the resin and the like) is preferably 2/7 to 8/2, more preferably 3/7 to 7/3. The polymerization temperature in obtaining the polymerized product of the composition can be 120° C. to 200° C.

The average thickness of the undercoat layer is preferably 0.3 μm or more and 15 μm or less, more preferably 0.5 μm or more and 5.0 μm or less.

In the present invention, no undercoat layer can be present in the second portion. In the present invention, examples of the method for forming the undercoat layer so that the undercoat layer is not present in the second portion include a method including preparing a coating liquid for an undercoat layer and coating only the first portion that is an image formation region, and a method including coating the entire with the coating liquid, and peeling-off and removing the undercoat layer only in the second portion. Examples of the former method include a method of not dipping the second portion in dip-coating of the photosensitive member with the coating liquid for an undercoat layer. Examples of the latter method include a method of dip-coating the photosensitive member with the coating liquid for an undercoat layer, and applying a solvent that can dissolve the undercoat layer, to the second portion for removal by use of a peeling-off member such as a rubber blade, a brush, a cleaning brush, a sponge or a fiber cloth.

In the former method, however, the coating liquid may also penetrate into the second portion, and in the latter method, peeling-off and removal of the undercoat layer in the second portion may not be completely performed. Even in such cases, the undercoat layer is partially present in the second portion, but the effect of the present invention is exerted.

More specifically, when the undercoat layer is partially present in the second portion, the area of the undercoat layer present in a region in contact with the abutting member (the total area of the undercoat layer present in a region that can be in contact with the abutting member/the total area of the region that can be in contact with the abutting member) is preferably 80% or less, more preferably 50% or less. The method of measuring the area of the undercoat layer present in the final photosensitive member is as follows.

First, the layers above the undercoat layer in the electrophotographic photosensitive member are peeled using a solvent, a hybrid laser microscope (manufactured by Lasertec Corporation) is used under the following measurement conditions to observe an image of the entire circumference of a region that can be in contact with the abutting member, of the second portion of the electrophotographic photosensitive member, and the area of a region having a luminance of 200 or more in the image is defined as "the total area of the undercoat layer present in the region that can be in contact with the abutting member".

(Measurement Conditions)

Light source: mercury/xenon lamp

Irradiation wavelength: 633 nm

Light reception range: only red region of 3CCD

Objective lens: 5-fold magnification (NA 0.15)

Amount of light to be set: 700

In addition, "the total area of the region that can be in contact with the abutting member" corresponds to the surface area of the entire circumference corresponding to the width of the abutting member, of the second portion of the electrophotographic photosensitive member, and, for example, when the width of the abutting member is 4 mm and the diameter of a cylinder is 30 mm, the area is calculated by 4 (mm)×the circumference length [30 (mm)×3.14] and is 376.8 mm.

Hereinafter, the electron transporting material, the cross-linking agent and the resin are described, respectively.

(1) Electron Transporting Material

Examples of the electron transporting material include a quinone compound, an imide compound, a benzimidazole compound and a cyclopentadienylidene compound. In the present invention, the electron transporting material is preferably an electron transporting material having a polymerizable functional group. In particular, the electron transporting material is more preferably an electron transporting material having two or more polymerizable functional groups in one molecule. Examples of the polymerizable functional group include a hydroxy group, a thiol group, an amino group, a carboxyl group and a methoxy group. In the present invention, the electron transporting material can be at least one selected from the group consisting of compounds represented by the following general formulae (A1) to (A11).

(A1)

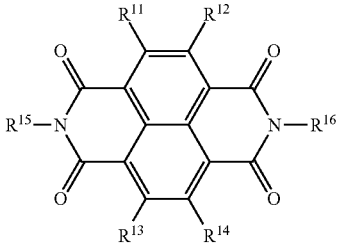

(A2)

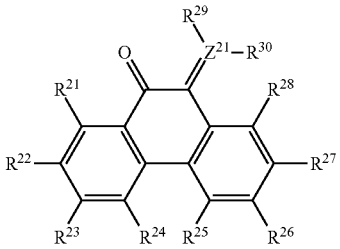

(A3)

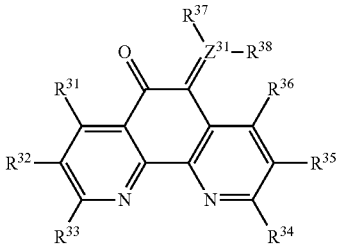

(A4)

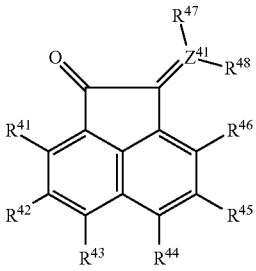

-continued (A5)

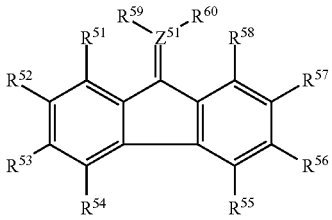

(A6)

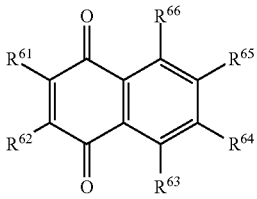

(A7)

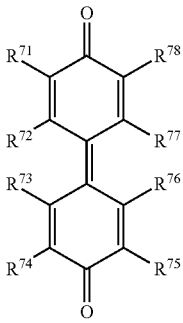

(A8)

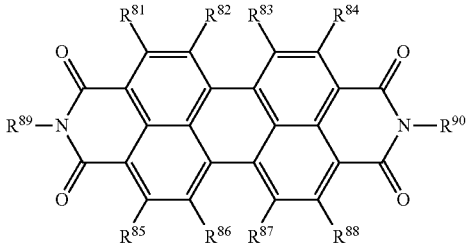

(A9)

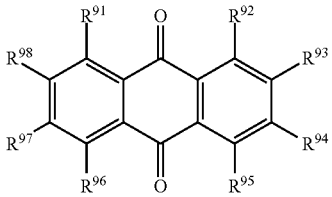

(A10)

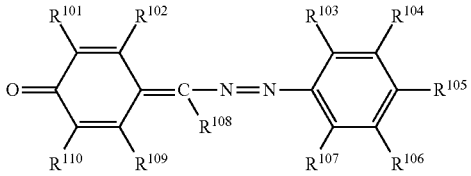

-continued (A11)

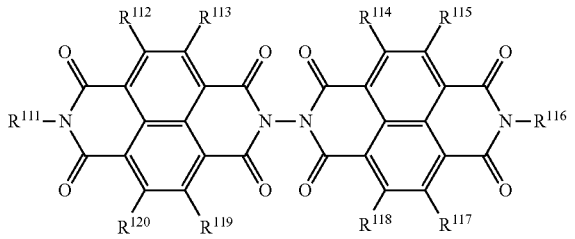

In the general formulae (A1) to (A11), at least one of $R^{11}$ to $R^{16}$, at least one of $R^{21}$ to $R^{30}$, at least one of $R^{31}$ to $R^{38}$, at least one of $R^{41}$ to $R^{48}$, at least one of $R^{51}$ to $R^{60}$, at least one of $R^{61}$ to $R^{66}$, at least one of $R^{71}$ to $R^{78}$, at least one of $R^{81}$ to $R^{90}$, at least one of $R^{91}$ to $R^{98}$, at least one of $R^{101}$ to $R^{110}$ and at least one of $R^{111}$ to $R^{120}$ each represent a monovalent group represented by the following general formula (A), and the others each independently represent a hydrogen atom, a cyano group, a nitro group, a halogen atom, an alkoxycarbonyl group, an alkyl group, an aryl group, a heterocyclic ring, or an alkyl group in which one $CH_2$ in the main chain is substituted with O, S, NH or $NR^{121}$ ($R^{121}$ represents an alkyl group). The alkyl group, the aryl group and the heterocyclic ring may further have a substituent. The substituent of the alkyl group includes an alkyl group, an aryl group, a halogen atom and an alkoxycarbonyl group. The substituent of each of the aryl group and the heterocyclic ring includes a halogen atom, a nitro group, a cyano group, an alkyl group, a halogen-substituted alkyl group and an alkoxy group.

$Z^{21}$, $Z^{31}$, $Z^{41}$ and $Z^{51}$ each independently represent a carbon atom, a nitrogen atom or an oxygen atom. When $Z^{21}$ represents an oxygen atom, $R^{29}$ and $R^{30}$ are not present, and when $Z^{21}$ represents a nitrogen atom, $R^{30}$ is not present. When $Z^{31}$ represents an oxygen atom, $R^{37}$ and $R^{38}$ are not present, and when $Z^{31}$ represents a nitrogen atom, $R^{38}$ is not present. When $Z^{41}$ represents an oxygen atom, $R^{47}$ and $R^{48}$ are not present, and when $Z^{41}$ represents a nitrogen atom, $R^{48}$ is not present. When $Z^{51}$ represents an oxygen atom, $R^{59}$ and $R^{60}$ are not present, and when $Z^{51}$ represents a nitrogen atom, $R^{60}$ is not present.

$$-(\alpha)_l-(\beta)_m-\gamma \quad \text{(A)}$$

In the general formula (A), at least one of α, β and γ is a group having a substituent, and such a substituent is selected from the group consisting of a hydroxy group, a thiol group, an amino group, a carboxyl group and a methoxy group. l and m each independently represent 0 or 1, and the sum of l and m is 0 or more and 2 or less.

α represents an alkylene group having 1 to 6 main-chain atoms, an alkylene group having 1 to 6 main-chain atoms, substituted with an alkyl group having 1 to 6 carbon atoms, an alkylene group having 1 to 6 main-chain atoms, substituted with a benzyl group, an alkylene group having 1 to 6 main-chain atoms, substituted with an alkoxycarbonyl group, or an alkylene group having 1 to 6 main-chain atoms, substituted with a phenyl group. Such groups may each have, as a substituent, at least one group selected from the group consisting of a hydroxy group, a thiol group, an amino group, a carboxyl group and a methoxy group. One $CH_2$ in the main chain of such an alkylene group may be substituted with O, S or $NR^{122}$ (wherein $R^{122}$ represents a hydrogen atom or an alkyl group.).

β represents a phenylene group, a phenylene group substituted with alkyl having 1 to 6 carbon atoms, a phenylene group substituted with nitro, a phenylene group substituted with a halogen group, or a phenylene group substituted with an alkoxy group. Such groups may each have, as a substituent, at least one group selected from the group consisting of a hydroxy group, a thiol group, an amino group, a carboxyl group and a methoxy group.

γ represents a hydrogen atom, an alkyl group having 1 to 6 main-chain atoms, or an alkyl group having 1 to 6 main-chain atoms, substituted with an alkyl group having 1 to 6 carbon atoms. Such groups may each have, as a substituent, at least one group selected from the group consisting of a hydroxy group, a thiol group, an amino group, a carboxyl group and a methoxy group. One $CH_2$ in the main chain of such an alkyl group may be substituted with O, S or $NR^{123}$ (wherein $R^{123}$ represents a hydrogen atom or an alkyl group.).

Hereinafter, specific examples of the compounds represented by the general formulae (A1) to (A11) are shown.

Specific examples of the compound represented by the general formula (A1)

| | $R^{11}$~$R^{14}$ | $R^{15}$ | $R^{16}$ |
|---|---|---|---|
| A101 | H | 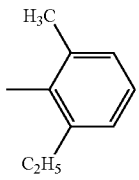 | 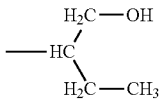 |
| A102 | H | 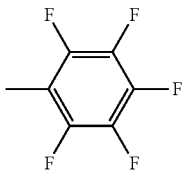 | 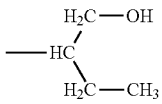 |

-continued
| | | | |
|---|---|---|---|
| A103 | H | 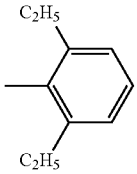 | 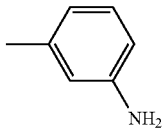 |
| A104 | H | 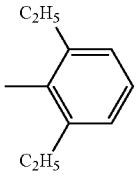 | 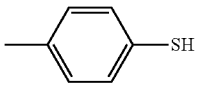 |
| A105 | H | 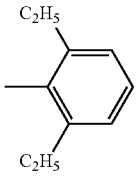 | 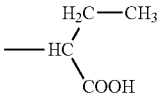 |
| A106 | H | 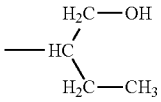 | 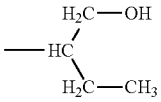 |
| A107 | H | 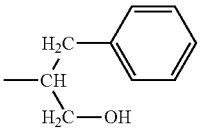 | 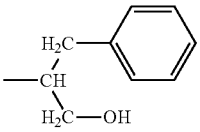 |
| A108 | H | 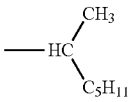 | 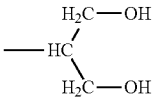 |
| A109 | H | 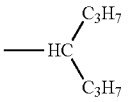 | 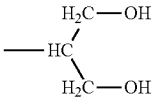 |
| A110 | H | 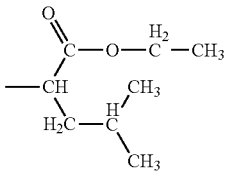 | 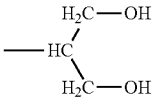 |
| A111 | H | 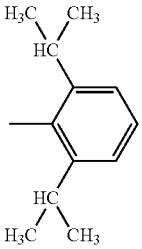 | 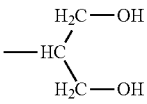 |

-continued
| | | | |
|---|---|---|---|
| A112 | H | 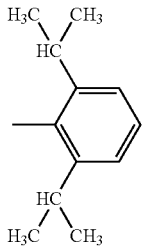 | 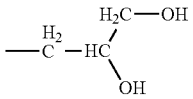 |
| A113 | H | 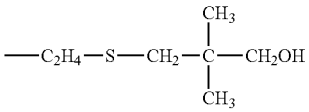 | 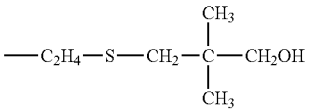 |
| A114 | H | 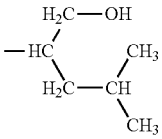 | 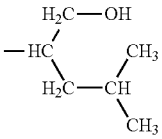 |
| A115 | H | 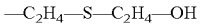 | 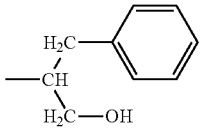 |
| A116 | H | 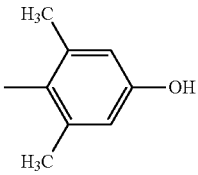 | 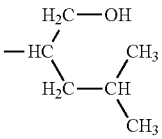 |
| A117 | H | 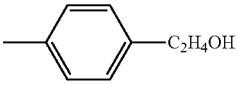 | 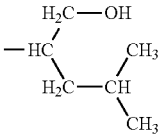 |
| A118 | H | 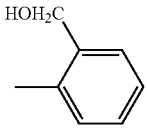 | 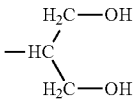 |
| A119 | H | 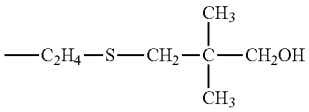 | 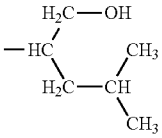 |
| A120 | H | 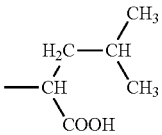 | 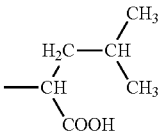 |

Specific examples of the compound represented by the general formula (A2)
| | $R^{21}$ | $R^{22}$ | $R^{23}$ | $R^{24}$ | $R^{25}$ |
|---|---|---|---|---|---|
| A201 | H | H | 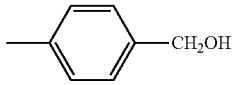 | H | H |
| A202 | H | H | H | H | H |
| A203 | H | H | 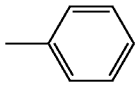 | H | H |
| A204 | H | H | 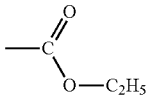 | H | H |
| A205 | H | H | 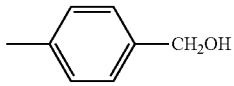 | H | H |
| A206 | H | 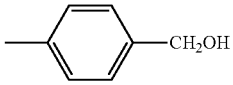 | H | H | H |
| | $R^{26}$ | $R^{27}$ | $R^{28}$ | $Z^{21}$ | $R^{29}$ |
|---|---|---|---|---|---|
| A201 | H | H | H | O | — |
| A202 | H | H | H | N | 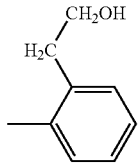 |
| A203 | 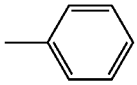 | H | H | N | 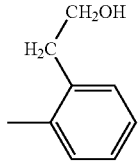 |
| A204 | 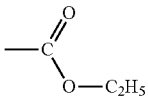 | H | H | N | 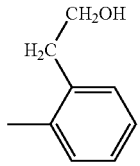 |
| A205 | 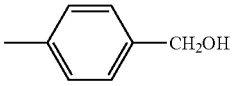 | H | H | O | — |
| A206 | H | 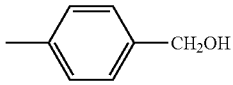 | H | O | — |

Specific examples of the compound represented by the general formula (A3)
| | $R^{31}$ | $R^{32}$ | $R^{33}$ | $R^{34}$ | $R^{35}$ | $R^{36}$ | $Z^{31}$ | $R^{37}$ | $R^{38}$ |
|---|---|---|---|---|---|---|---|---|---|
| A301 | H | 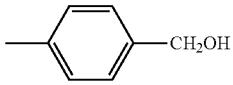 | H | H | H | H | O | — | — |
| A302 | H | H | H | H | H | H | N | 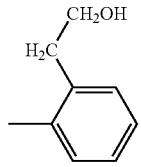 | — |
| A303 | H | H | H | H | H | H | N | 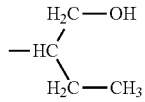 | — |
| A304 | H | H | Cl | Cl | H | H | N | 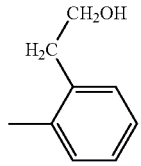 | — |
| A305 | H | 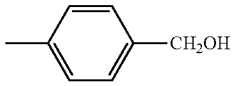 | H | H | 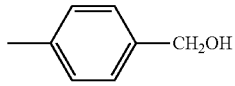 | H | C | CN | CN |
Specific examples of the compound represented by the general formula (A4)
| | $R^{41}$ | $R^{42}$ | $R^{43}$ | $R^{44}$ | $R^{45}$ | $R^{46}$ | $Z^{41}$ | $R^{47}$ | $R^{48}$ |
|---|---|---|---|---|---|---|---|---|---|
| A401 | H | H | 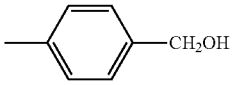 | H | H | H | C | CN | CN |
| A402 | H | H | H | H | H | H | N | 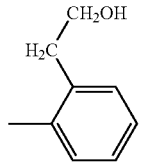 | — |
| A403 | H | H | 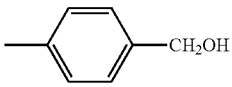 | 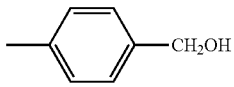 | H | H | C | CN | CN |
| A404 | H | H | 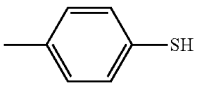 | 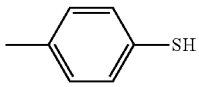 | H | H | C | CN | CN |
| A405 | H | H | 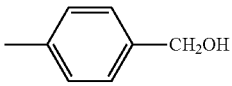 | 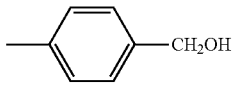 | H | H | O | — | — |

Specific examples of the compound represented by the general formula (A5)
| | $R^{51}$ | $R^{52}$ | $R^{53}$ | $R^{54}$ | $R^{55}$ | $R^{56}$ |
|---|---|---|---|---|---|---|
| A501 | H | 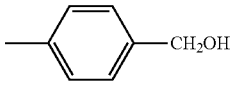 | H | H | H | H |
| A502 | H | $NO_2$ | H | H | $NO_2$ | H |
| A503 | H | 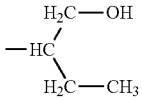 | H | H | H | H |
| A504 | H | H | 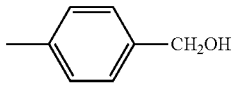 | H | H | 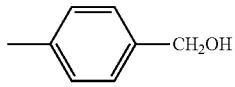 |
| | $R^{57}$ | $R^{58}$ | $Z^{51}$ | $R^{59}$ | $R^{60}$ |
|---|---|---|---|---|---|
| A501 | H | H | C | CN | CN |
| A502 | $NO_2$ | H | N | 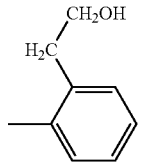 | — |
| A503 | 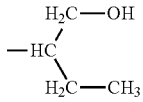 | H | C | CN | CN |
| A504 | H | H | C | CN | CN |
Specific examples of the compound represented by the general formula (A6)
| | $R^{61}$ | $R^{62}$ | $R^{63}$~$R^{66}$ |
|---|---|---|---|
| A601 | 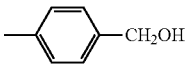 | H | H |
| A602 | 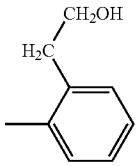 | H | H |
-continued
| | $R^{61}$ | $R^{62}$ | $R^{63}$~$R^{66}$ |
|---|---|---|---|
| A603 | 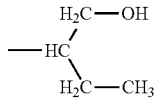 | H | H |
| A604 | 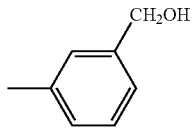 | 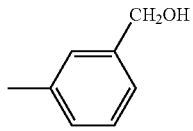 | H |
| A605 | 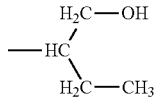 | 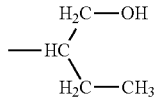 | H |

Specific examples of the compound represented by the general formula (A7)

| | $R^{71}$ | $R^{72}$~$R^{74}$ | $R^{75}$ | $R^{76}$~$R^{78}$ |
|---|---|---|---|---|
| A701 | 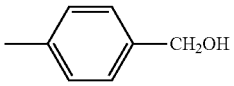 | H | H | H |
| A702 | 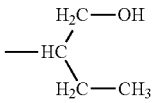 | H | H | H |
| A703 | 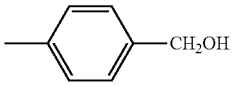 | H | 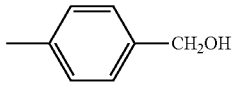 | H |
| A704 | 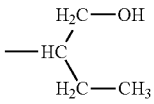 | H | 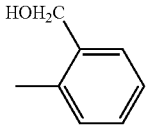 | H |
| A705 | 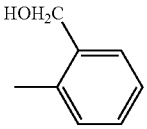 | H | $-(CH_2)_5OH$ | H |

Specific examples of the compound represented by the general formula (A8)

| | $R^{81}$ | $R^{82}$ | $R^{63}$~$R^{66}$ | $R^{67}$ | $R^{68}$ | $R^{69}$ | $R^{90}$ |
|---|---|---|---|---|---|---|---|
| A801 | H | H | H | H | H | 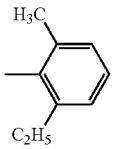 | 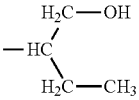 |
| A802 | H | H | H | H | H | 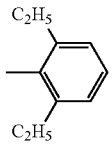 | 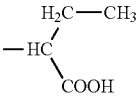 |
| A803 | H | CN | H | CN | H | 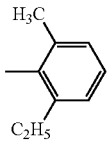 | 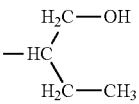 |

-continued

| | $R^{81}$ | $R^{82}$ | $R^{63}$~$R^{66}$ | $R^{67}$ | $R^{68}$ | $R^{69}$ | $R^{90}$ |
|---|---|---|---|---|---|---|---|
| A804 | H | H | H | H | H | 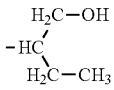 | 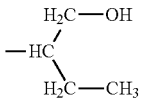 |
| A805 | H | H | H | H | H | 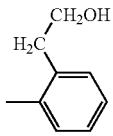 | 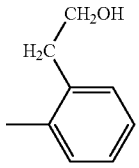 |

Specific examples of the compound represented by the general formula (A9)

| | $R^{91}$ | $R^{92}$ | $R^{93}$ | $R^{94}$ | $R^{95}$ | $R^{96}$ | $R^{97}$ | $R^{98}$ |
|---|---|---|---|---|---|---|---|---|
| A901 | $-CH_2-OH$ | H | H | H | H | H | H | H |
| A902 | $-(CH_2)_2OH$ | H | H | H | H | H | H | H |
| A903 | H | H | H | H | H | H | H | $-CH_2-OH$ |

-continued

| | $R^{91}$ | $R^{92}$ | $R^{93}$ | $R^{94}$ | $R^{95}$ | $R^{96}$ | $R^{97}$ | $R^{98}$ |
|---|---|---|---|---|---|---|---|---|
| A904 | H | H | H | H | H | H | H | $-(CH_2)_2OH$ |
| A905 | H | CN | H | H | H | H | CN | 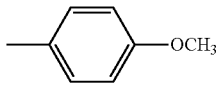 |
| A906 | $-(CH_2)_2OH$ | $-(CH_2)_2OH$ | H | $NO_2$ | H | H | $NO_2$ | H |
| A907 | H | $-CH_2-OH$ | $-CH_2-OH$ | H | H | H | H | H |

Specific examples of the compound represented by the general formula (A10)

| | $R^{101}$ | $R^{102}$~$R^{104}$ | $R^{105}$ | $R^{106}$~$R^{109}$ | $R^{110}$ |
|---|---|---|---|---|---|
| A1001 | 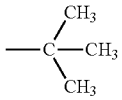 | H | $-CH_2-OH$ | H | 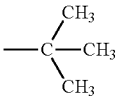 |
| A1002 | 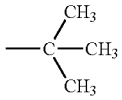 | H | 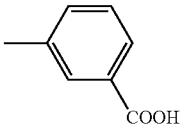 | H | 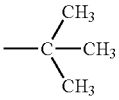 |
| A1003 | 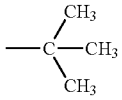 | H | 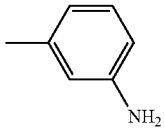 | H | 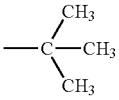 |
| A1004 | 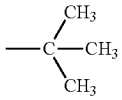 | H | 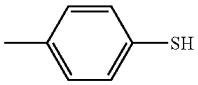 | H | 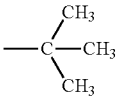 |
| A1005 | 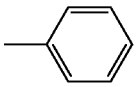 | H | $-CH_2-OH$ | H | 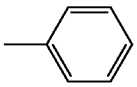 |

Specific examples of the compound represented by the general formula (A11)

| | $R^{111}$ | $R^{112}$~$R^{115}$ | $R^{116}$ | $R^{117}$~$R^{120}$ |
|---|---|---|---|---|
| A1101 | 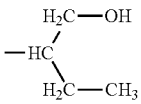 | H | 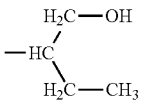 | H |
| A1102 | 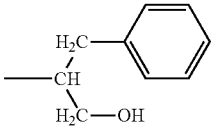 | H | 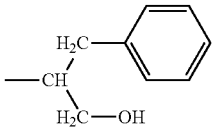 | H |

-continued

| | $R^{111}$ | $R^{112}$~$R^{115}$ | $R^{116}$ | $R^{117}$~$R^{120}$ |
|---|---|---|---|---|
| A1103 | 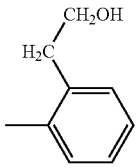 | H | 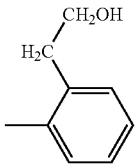 | H |
| A1104 | 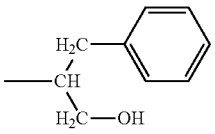 | H | 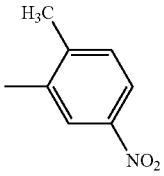 | H |
| A1105 | 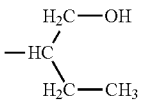 | H | 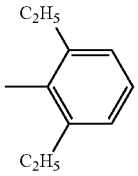 | H |

The compound represented by each of the general formulae (A1) to (A11) can be obtained as follows: a derivative having the structure of each of the general formulae (A1) to (A11) (compound in which the polymerizable functional group of the compound represented by each of the general formulae (A1) to (A11) is substituted with a halogen atom) is obtained, and thereafter the polymerizable functional group (a hydroxy group, a thiol group, an amino group, a carboxyl group and a methoxy group) is introduced thereto.

The method of obtaining the derivative having the structure represented by each of the general formulae (A1) to (A11) is as follows. The derivative having the structure of the general formula (A1) can be synthesized by a reaction of naphthalenetetracarboxylic dianhydride and a monoamine derivative that can be purchased from Tokyo Chemical Industry Co., Ltd. and Johnson Matthey Japan Inc. The derivative having the structure of each of the general formulae (A2) to (A6) and (A9) (derivative of the electron transporting material) can be purchased from Tokyo Chemical Industry Co., Ltd., Sigma-Aldrich Co. LLC. and Johnson Matthey Japan Inc. The derivative having the structure of the general formula (A7) can be synthesized using a phenol derivative that can be purchased from Tokyo Chemical Industry Co., Ltd. or Sigma-Aldrich Co. LLC., as a raw material. The derivative having the structure of the general formula (A8) can be synthesized by a reaction of perylenetetracarboxylic dianhydride and a monoamine derivative that can be purchased from Tokyo Chemical Industry Co., Ltd. and Sigma-Aldrich Co. LLC. The derivative having the structure of the general formula (A10) can be synthesized by oxidizing a phenol derivative having a hydrazone structure by an appropriate oxidant such as potassium permanganate in an organic solvent by use of a known synthesis method (for example, Japanese Patent No. 3717320). The derivative having the structure of the general formula (A11) can be synthesized by a reaction of naphthalenetetracarboxylic dianhydride, a monoamine derivative and hydrazine that can be purchased from Tokyo Chemical Industry Co., Ltd., Sigma-Aldrich Co. LLC. and Johnson Matthey Japan Inc.

The method of introducing the polymerizable functional group to the derivative having the structure of each of the general formulae (A1) to (A11) (hereinafter, simply also referred to as "derivative") is as follows. Examples include a method involving introducing an aryl group having the polymerizable functional group to the derivative by use of a cross-coupling reaction using a palladium catalyst and a base; a method involving introducing an alkyl group having the polymerizable functional group to the derivative by use of a cross-coupling reaction using a $FeCl_3$ catalyst and a base; and a method involving introducing a hydroxyalkyl group and a carboxyl group to the derivative by action of an epoxy compound and $CO_2$ after lithiation.

(2) Cross-Linking Agent

Any of known materials can be used as the cross-linking agent. Specifically, examples include compounds described in "Cross-linking Agent Handbook", written by Shinzo YAMASHITA and Tosuke KANEKO and published by Taiseisha Ltd. (1981). In the present invention, the cross-linking agent can have a polymerizable functional group.

In the present invention, the cross-linking agent can be an isocyanate compound or an amino compound. Hereinafter, the respective compounds are described.

(2-1) Isocyanate Compound

In the present invention, the isocyanate compound has an isocyanate group. The number of isocyanate groups in one molecule can be 3 to 6. The isocyanate compound may be difficult to control the reactivity thereof, and therefore can be used in the form of a block isocyanate compound, in which the isocyanate group is protected by a protective group, when added into the coating liquid.

The protective group that protects the isocyanate group can be a group represented by any of the following formula (H1) to formula (H6). The isocyanate group protected by such a protective group is in the form of —NHCOX (X represents the protective group).

(H1)

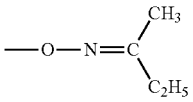

(H2)

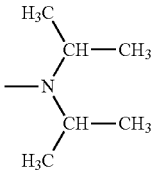

(H3)

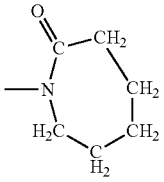

(H4)

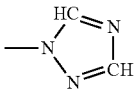

(H5)

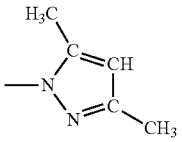

-continued (H6)

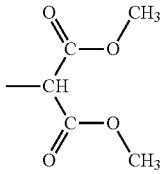

Specific examples of the isocyanate compound include various modified products such as isocyanurate modified products, biuret modified products and allophanate modified products of diisocyanates such as triisocyanatobenzene, triisocyanatomethylbenzene, triphenylmethane triisocyanate, lysine triisocyanate, tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanate hexanoate and norbornane diisocyanate, and adduct modified products thereof with trimethylolpropane and pentaerythritol. In particular, an isocyanurate modified product or an adduct modified product can be adopted.

Hereinafter, B1 to B21 are shown as specific examples of the isocyanate compound.

B1

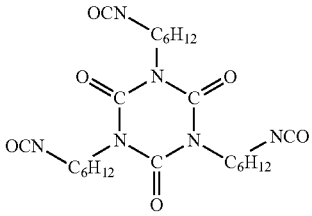

B2

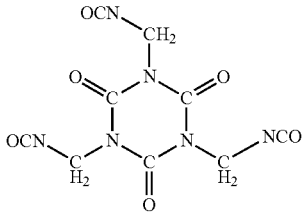

B3

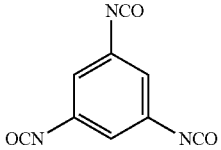

B4

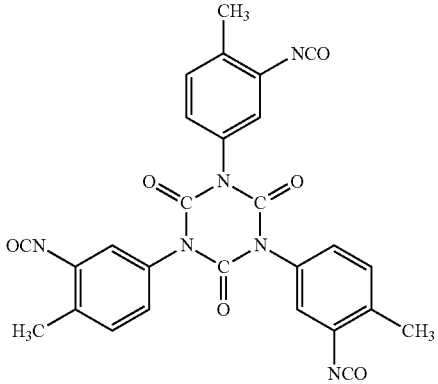

-continued
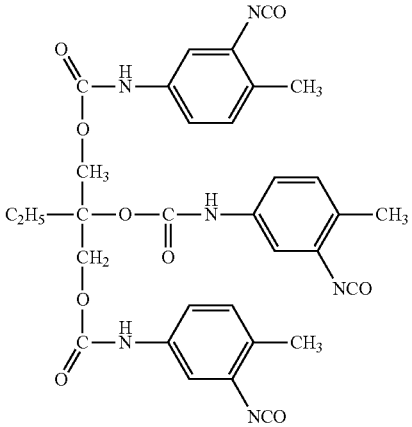
B5
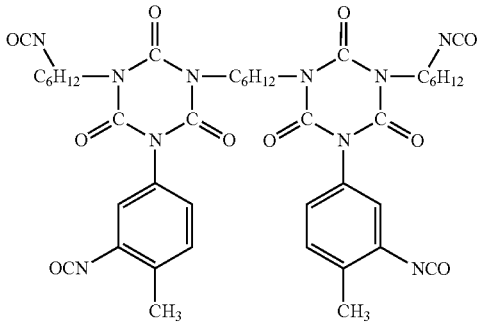
B6
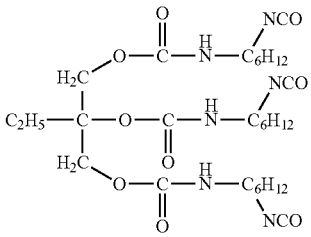
B7
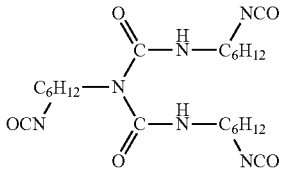
B8
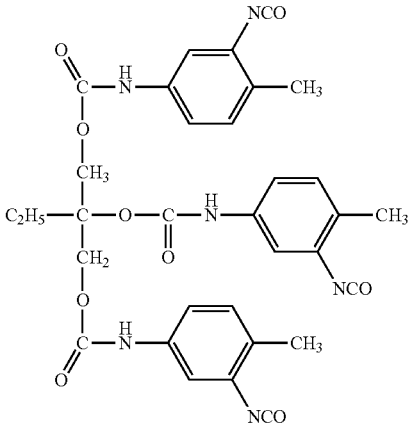
B5
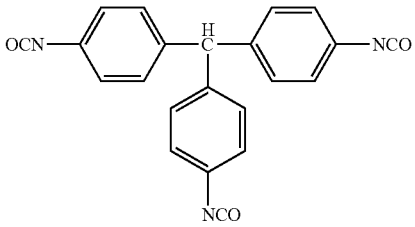
B9
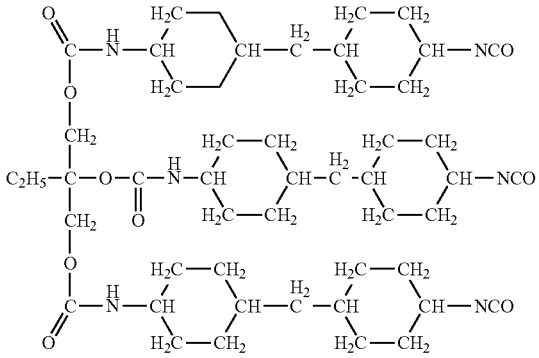
B10

-continued
B11
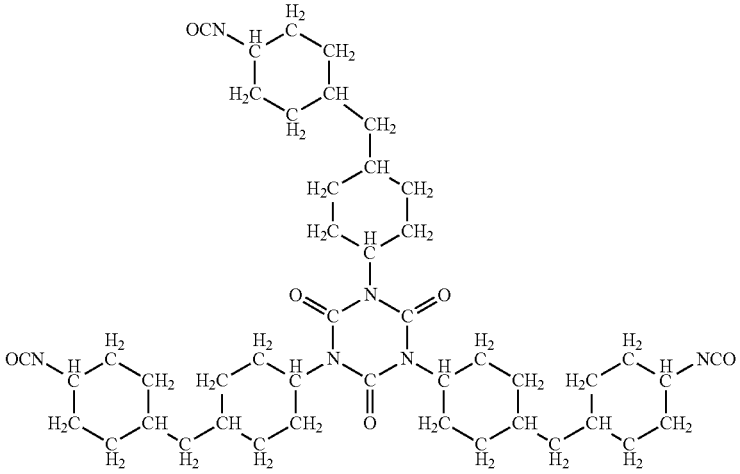
B12
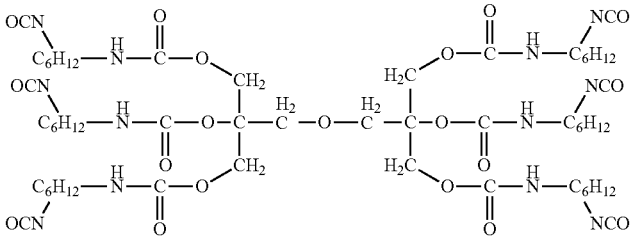
B13
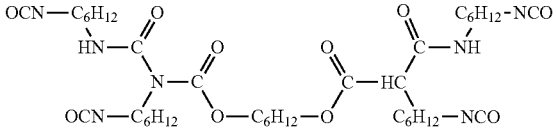
B14
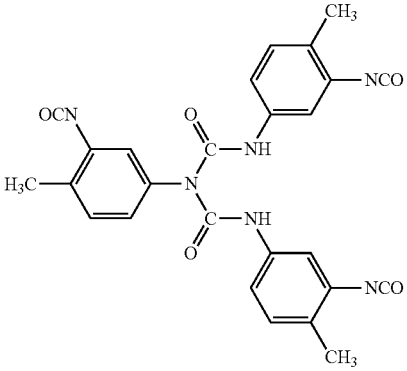
B14
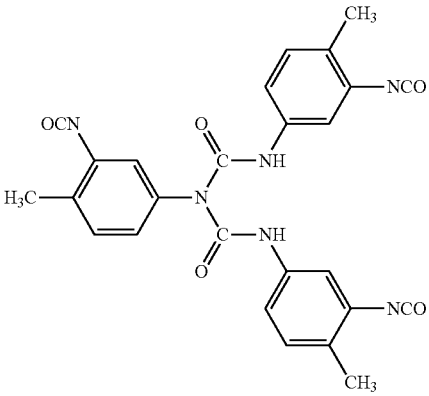

-continued
B15
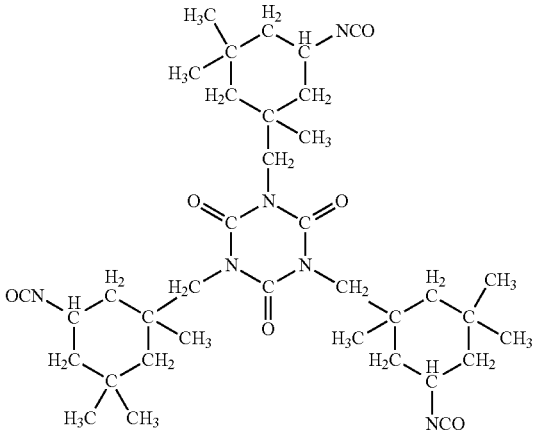
B16
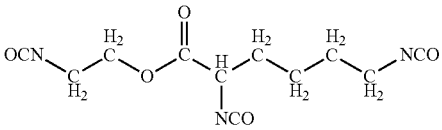
B17
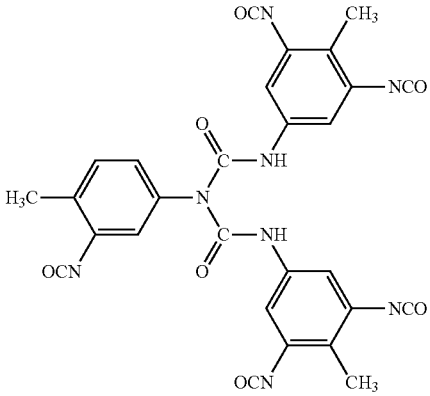
B18
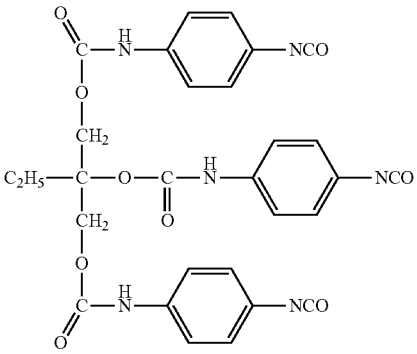
B19
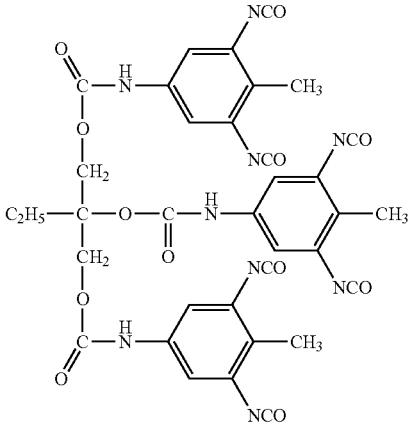
B20
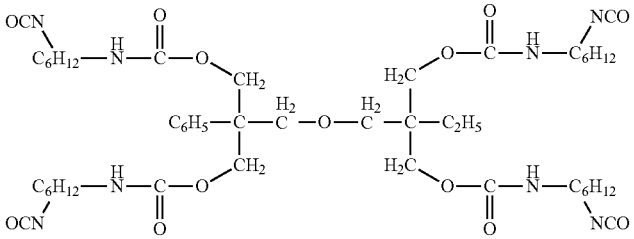

-continued

B21

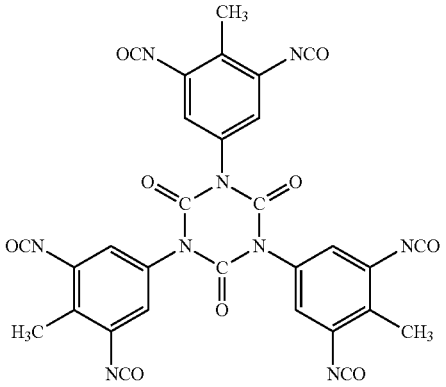

(2-2) Amino Compound

In the present invention, the amino compound can be a compound having a group represented by —$CH_2$—OH or —$CH_2$—O—$R^1$ ($R^1$ represents an alkyl group (which may be branched) having 1 or more and 10 or less carbon atoms). Furthermore, a compound represented by any of the following general formulae (C1) to (C5) is preferable, and the compound more preferably has a molecular weight of 200 or more and 1,000 or less from the viewpoint of forming a uniform cured film.

(C1)

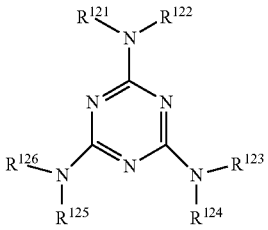

(C2)

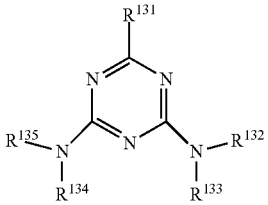

(C3)

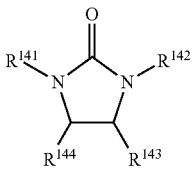

(C4)

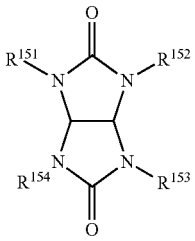

-continued (C5)

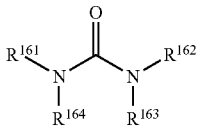

In the general formulae (C1) to (C5), $R^{121}$ to $R^{126}$, $R^{131}$ to $R^{135}$, $R^{141}$ to $R^{144}$, $R^{151}$ to $R^{154}$ and $R^{161}$ to $R^{164}$ each independently represent a hydrogen atom, —$CH_2$—OH or —$CH_2$—O—$R^1$, and $R^1$ represents an alkyl group (which may be branched) having 1 or more and 10 or less carbon atoms. The alkyl group can be a methyl group, an ethyl group or a butyl group in terms of polymerizability.

With respect to commercially available materials, the compound represented by the general formula (C1) includes Super Melamine 90 (produced by NOF Corporation), Super Beckamine® TD-139-60, L-105-60, L127-60, L110-60, J-820-60 and G-821-60 (produced by DIC Corporation), Uban 2020 (produced by Mitsui Chemicals, Inc.), Sumitec Resin M-3 (produced by Sumitomo Chemical Co., Ltd.), and Nikalac MW-30, MW-390 and MX-750LM (produced by Nippon Carbide Industries Co., Inc.); the compound represented by the general formula (C2) includes Super Beckamine® L-148-55, 13-535, L-145-60 and TD-126 (produced by DIC Corporation), and Nikalac BL-60 and BX-4000 (produced by Nippon Carbide Industries Co., Inc.); the compound represented by the general formula (C3) includes Nikalac MX-280 (produced by Nippon Carbide Industries Co., Inc.); the compound represented by the general formula (C4) includes Nikalac MX-270 (produced by Nippon Carbide Industries Co., Inc.); and the compound represented by the general formula (C5) includes Nikalac MX-290 (produced by Nippon Carbide Industries Co., Inc.).

Hereinafter, specific examples of the respective compounds represented by the general formulae (C1) to (C5) are shown. Herein, monomers are shown in the following specific examples, but oligomers that are polymers having such a monomer as a structural unit may be adopted. The polymers can have a degree of polymerization of 2 or more and 100 or less. The monomers may be used as a mixture of two or more.

Compounds represented by the general formula (C1)
C1-1
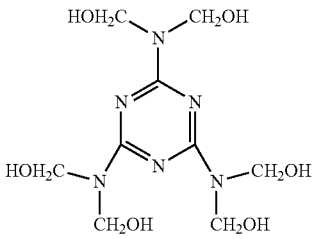
C1-2
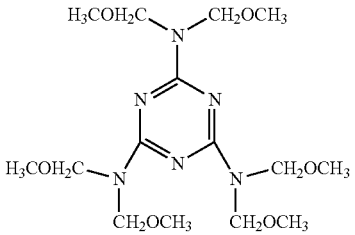
C1-3
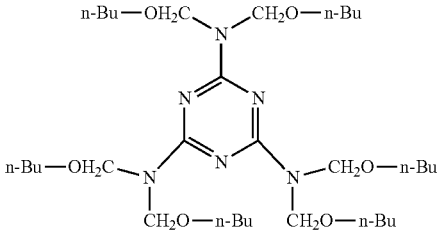
C1-4
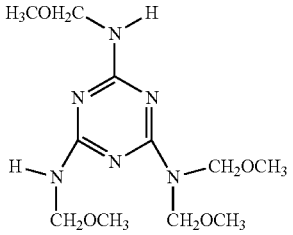
C1-5
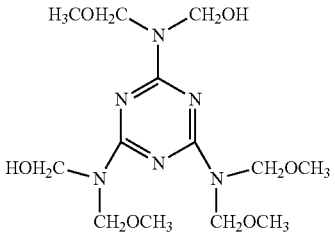
C1-6
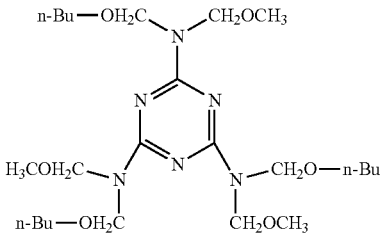
-continued
C1-7
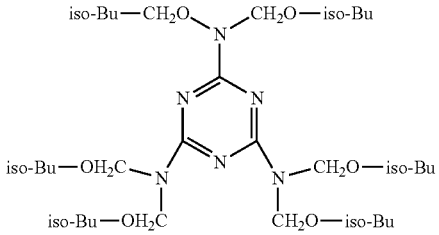
C1-8
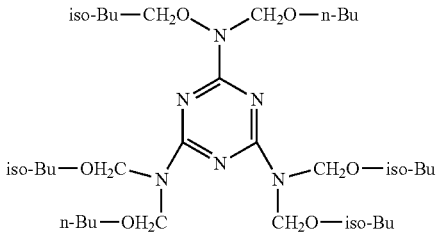
C1-9
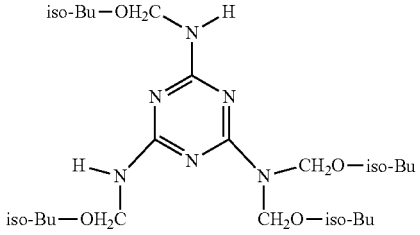
C1-10
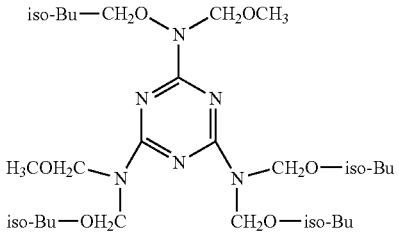
C1-11
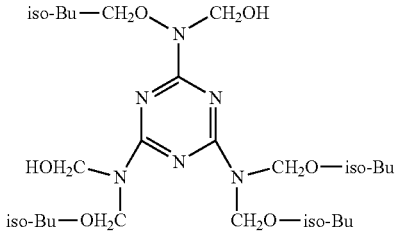
C1-12
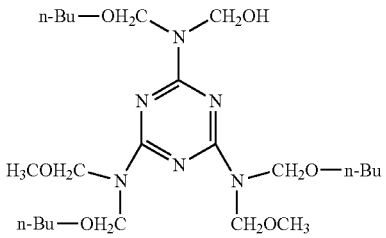

Compounds represented by the general formula (C2)
C2-1
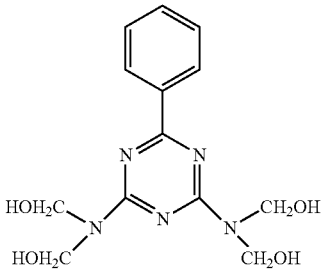
C2-2
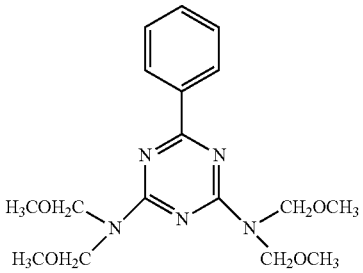
C2-3
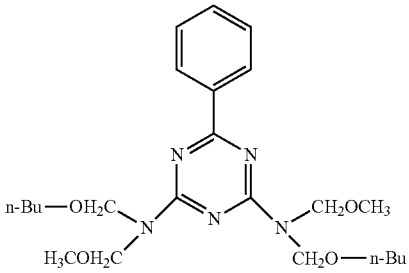
C2-4
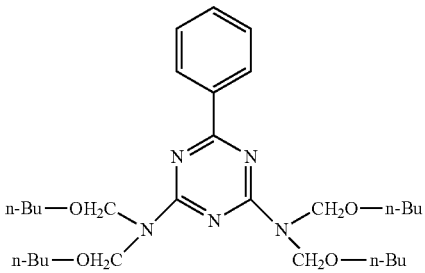
C2-5
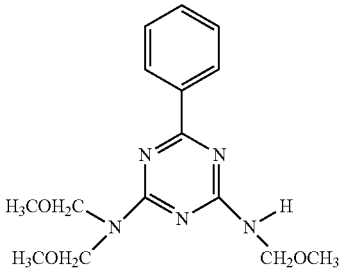
-continued
C2-6
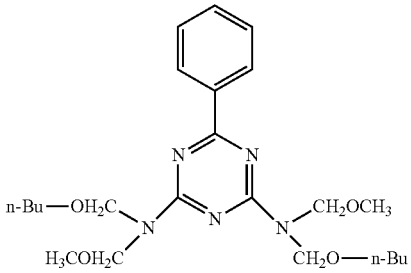
C2-7
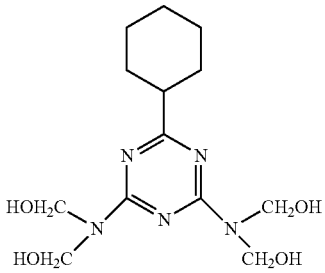
C2-8
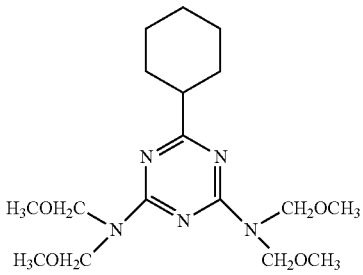
C2-9
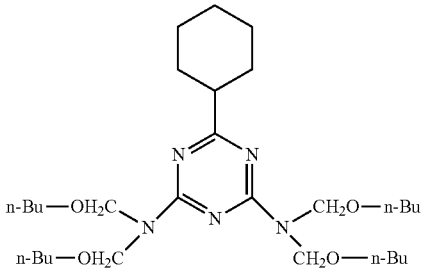
C2-10
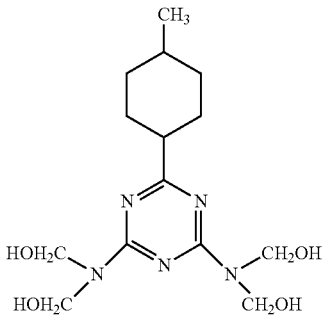

-continued
C2-11
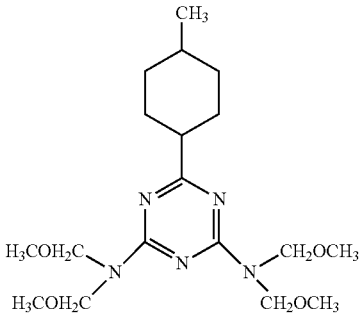
C2-12
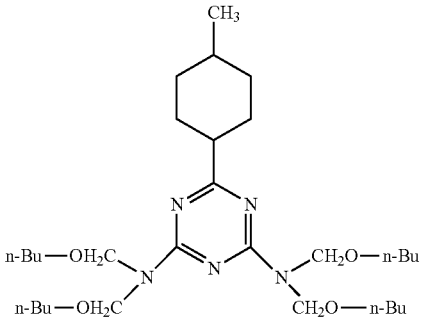
C2-13
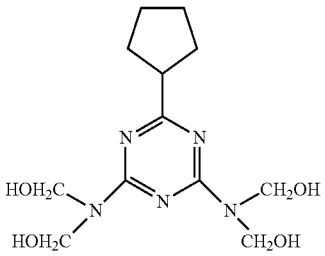
C2-14
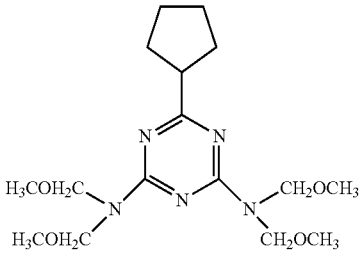
C2-15
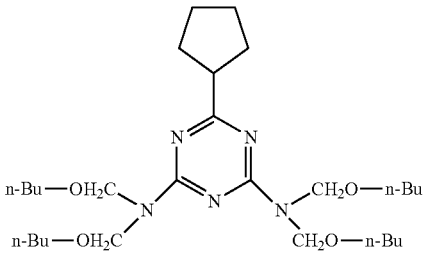
-continued
C2-16
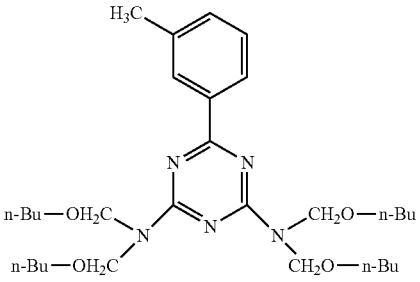
C2-17
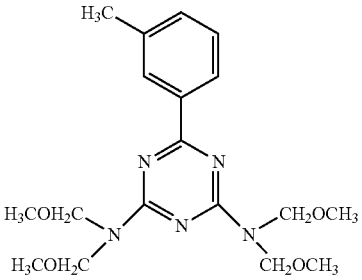
C2-18
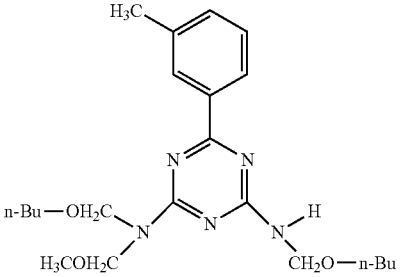
Compounds represented by the general formula (C3)
C3-1
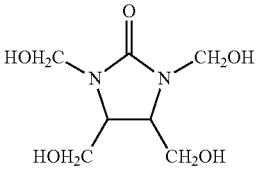
C3-2
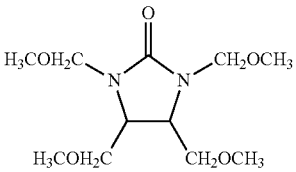
C3-3
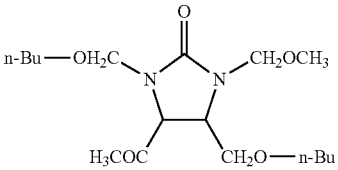

-continued
C3-4
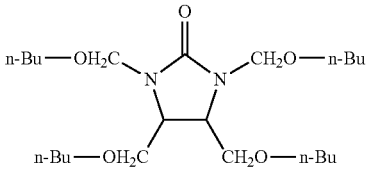
C3-5
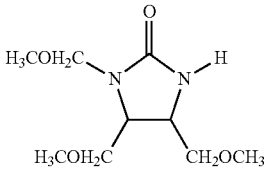
C3-6
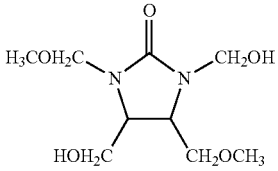
Compounds represented by the general formula (C4)
C4-1
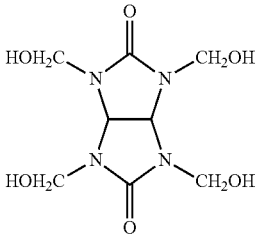
C4-2
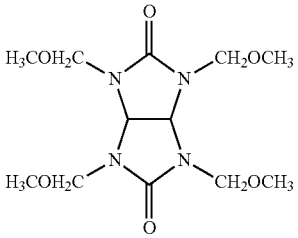
C4-3
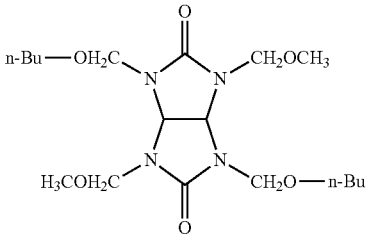
-continued
C4-4
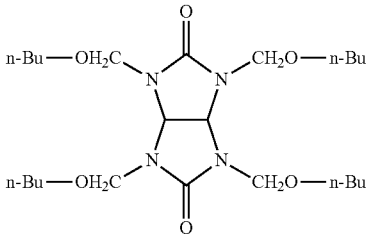
C4-5
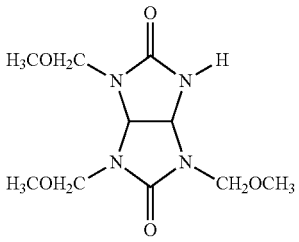
C4-6
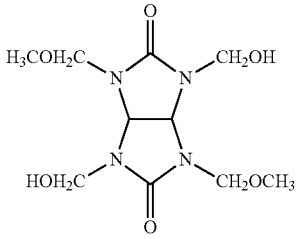
Compounds represented by the general formula (C5)
C5-1
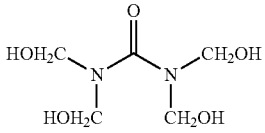
C5-2
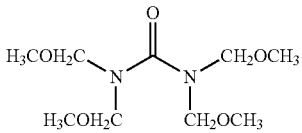
C5-3
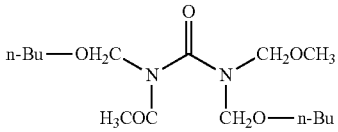
C5-4
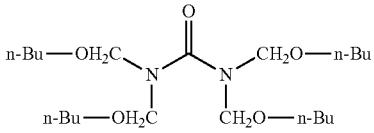
C5-5
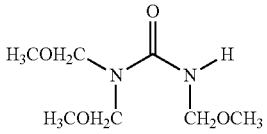

-continued

C5-6

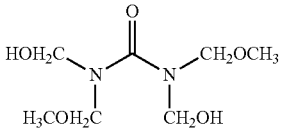

(3) Resin

In the present invention, the undercoat layer may contain a polymerized product of a composition including an electron transporting material, a cross-linking agent and a resin. The weight average molecular weight of the resin can be 5,000 or more and 400,000 or less.

The resin can be a thermoplastic resin, and examples include a polyacetal resin, a polyolefin resin, a polyester resin, a polyether resin and a polyamide resin. Furthermore, the resin can have a polymerizable functional group. The polymerizable functional group includes a hydroxy group, a thiol group, an amino group, a carboxyl group and a methoxy group. That is, the resin can have a structural unit represented by the following general formula (D).

(D)

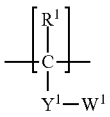

In the general formula (D), $R^1$ represents a hydrogen atom or an alkyl group. $Y^1$ represents a single bond, an alkylene group or a phenylene group. $W^1$ represents a hydroxy group, a thiol group, an amino group, a carboxyl group or a methoxy group.

Examples of a commercially available one as the thermoplastic resin having a polymerizable functional group include:

polyether polyol type resins such as AQD-457 and AQD-473 (all produced by Nippon Polyurethane Industry Co., Ltd.), and GP-400 and GP-700 (all are Sunnix produced by Sanyo Chemical Co., Ltd.);

polyester polyol type resins such as Phthalkid W2343 (produced by Hitachi Chemical Co., Ltd.), Watersol S-118, CD-520, Beckolite M-6402-50 and M-6201-40IM (all produced by DIC Corporation), Haridip WH-1188 (produced by Harima Chemicals Group, Inc.), and ES3604 and ES6538 (all produced by Japan Upica Co., Ltd.);

polyacryl polyol type resins such as Burnock WE-300 and WE-304 (all produced by DIC Corporation);

polyvinyl alcohol type resins such as Kuraray Poval PVA-203 (produced by Kuraray Co., Ltd.);

polyvinyl acetal type resins such as BX-1, BM-1 and KS-5 (all produced by Sekisui Chemical Co., Ltd.);

polyamide type resins such as Toresin FS-350 (produced by Nagase ChemteX Corporation);

carboxyl group-containing resins such as Aqualic (produced by Nippon Shokubai Co., Ltd.), and Finelex SG2000 (produced by Namariichi Co., Ltd.);

polyamine resins such as Rackamide (produced by DIC Corporation); and polythiol resins such as QE-340M (produced by Toray Industries, Inc.). In particular, a polyvinyl acetal type resin having a polymerizable functional group, a polyester polyol type resin having a polymerizable functional group, or the like is more preferable in terms of polymerizability and uniformity of the undercoat layer.

(Intermediate Layer)

The electrophotographic photosensitive member of the present invention has, in the second portion, an intermediate layer containing a metal oxide particle and a phenol resin, the layer being between and adjacent to the support and the charge generation layer.

The average thickness of the intermediate layer is preferably 2 μm or more and 40 μm or less, more preferably 10 μm or more and 30 μm or less.

The ten-point average roughness $Rz_{JIS}$ (standard length: 0.8 mm) of the surface of the intermediate layer according to JIS B 0601:2001 can be 0.5 μm or more and 2.5 μm or less.

Examples of the metal oxide particle include zinc oxide, white lead, aluminum oxide, indium oxide, silicon oxide, zirconium oxide, tin oxide, titanium oxide, magnesium oxide, antimony oxide, bismuth oxide, tin-doped indium oxide, antimony or tantalum-doped tin oxide and zirconium oxide particles. In particular, zinc oxide, titanium oxide and tin oxide particles can be adopted.

Examples of the method for dispersing the metal oxide particle in a coating liquid for an intermediate layer include a method involving using a paint shaker, a sand mill, a ball mill or a liquid collision type high-speed disperser. In order to enhance dispersibility of the metal oxide particle, the surface of the metal oxide particle may also be treated with a silane coupling agent or the like. Furthermore, in order to control resistivity of the intermediate layer, the metal oxide particle may also be doped with other metal or metal oxide.

The number average particle size of the metal oxide particle is preferably 30 to 450 nm, more preferably 30 to 250 nm in order to suppress the occurrence of a black point due to formation of a local conductive path.

As the phenol resin, any of known resins can be used. In particular, a resol type phenol resin can be used. The resol type phenol resin has a self-reactive functional group, and can be cured by heating, as it is. Examples of a commercially available one include Phenolite Series (produced by DIC Corporation).

In the present invention, the content of the metal oxide particle in the intermediate layer is preferably 0.5 times or more and 5 times or less, more preferably 1 time or more and 3 times or less the content of the phenol resin in terms of the mass ratio.

In the present invention, the intermediate layer may contain a resin other than the phenol resin. Specifically, examples include polymers and copolymers of vinyl compounds such as styrene, vinyl acetate, vinyl chloride, acrylate, methacrylate, vinylidene fluoride and trifluoroethylene, and a polyvinyl alcohol resin, a polycarbonate resin, a polyester resin, a polysulfone resin, a polyphenylene oxide resin, a cellulose resin, a silicone resin and an epoxy resin. In the present invention, 50% by mass of the resin for use in the intermediate layer can be the phenol resin from the viewpoint of an enhancement in adhesiveness.

The intermediate layer can further contain a resin particle having an average particle size of 1 μm or more and 5 μm or less. Such a configuration can suppress the following: the surface of the intermediate layer is roughened and light reflected on the surface of the intermediate layer interferes to cause interference fringes on an image output. Examples of the resin particle include thermosetting resin particles such as curable rubber, polyurethane, epoxy resin, alkyd resin, phenol resin, polyester, silicone resin and acryl-melamine resin particles. In particular, a silicone resin particle that hardly aggregates can be adopted.

The intermediate layer can be formed by preparation of a coating liquid for an intermediate layer, and coating of the coating liquid. The coating liquid for an intermediate layer can contain a solvent together with the materials such as the resin. Examples of the solvent include an alcohol type solvent such as methanol, ethanol or isopropanol, a sulfoxide type solvent, a ketone type solvent such as acetone, methyl ethyl ketone or cyclohexanone, an ether type solvent such as tetrahydrofuran, dioxane, ethylene glycol monomethyl ether or propylene glycol monomethyl ether, an ester type solvent such as methyl acetate or ethyl acetate, or an aromatic hydrocarbon solvent such as toluene or xylene.

In the present invention, a hydroxyl group can remain on the surface after coating of the coating liquid for an intermediate layer, and heating and curing thereof. The reason for this is because an unreacted hydroxyl group derived from the phenol resin remaining on the surface of the intermediate layer and a hydroxyl group derived from the polyacetal resin of the charge generation layer are partially reacted to thereby allow strong adhesiveness to be exhibited. Whether or not a hydroxyl group remains on the surface of the intermediate layer before coating with the charge generation layer can be confirmed by the following method using the infrared ATR method.

The surface of the intermediate layer before coating with the charge generation layer is subjected to measurement by the infrared ATR method, and when the peak strengths of $P_1$: peak derived from a hydroxyl group (peak at 3335 $cm^{-1}$)

$P_2$: peak derived from stretching of a benzene ring (peak at 1625 $cm^{-1}$), and $P_3$: peak derived from a C=O group (peak at 650 $cm^{-1}$)

satisfy the following relationship, it is determined that "a hydroxyl group remains on the intermediate layer".

$$P_1/(P_2+P_3) \geq 1.0$$

Furthermore, the value calculated by the above expression can be 1.5 or less. Such an upper limit is satisfied to thereby result in particularly proper curing of the intermediate layer, enhancing electrophotographic properties. The measurement by the infrared ATR method can be specifically performed according to the following outline. First, the support on which the intermediate layer is formed is cut out to a size of 1 cm×1 cm. The resultant is placed on a sample stage of a Frontier FT IR spectrometer (manufactured by PerkinElmer Co., Ltd.) and subjected to measurement by the microscopic ATR-IR method (abutting of a germanium prism with the surface of a sample, pressure gauge: 50) under measurement conditions of a scan resolution of 4 $cm^{-1}$ and a cumulative number of 8. The data after the measurement is subjected to baseline correction between 2 points: 3998 $cm^{-1}$ and 2500 $cm^{-1}$ and between 2 points: 1800 $cm^{-1}$ and 1554 $cm^{-1}$.

<Abutting Member>

In the present invention, an abutting member abuts with the surface of the second portion of the electrophotographic photosensitive member. Examples of the abutting member include a gap holding member that holds a gap between the charging member and/or the developer carrying member, and the electrophotographic photosensitive member.

As the gap holding member, a cylindrical member having a certain thickness, or the like is used. The material thereof includes a polyolefin resin such as polyethylene; a polyester resin such as polyethylene terephthalate; a fluororesin such as polytetrafluoroethylene; an acetal resin such as polyoxymethylene; a rubber such as a polyisoprene rubber (natural rubber), a polyurethane rubber, a chloroprene rubber, an acrylonitrile/butadiene rubber, a silicone rubber or a fluoro-rubber; or a metal having elasticity, such as aluminum, iron, copper, titanium or an alloy mainly including such a metal.

Examples of the abutting member in the present invention also include an end portion sealing member that abuts with the electrophotographic photosensitive member. The end portion sealing member is provided on each of both end portions of a cleaning blade in the longitudinal direction so that a developer does not leak from between the electrophotographic photosensitive member (or cleaning blade) and a cleaning frame. In use of the end portion sealing member, a carrier may be interposed between the end portion sealing member and the electrophotographic photosensitive member to thereby apply pressure to the electrophotographic photosensitive member, causing layer peeling-off, which is a technical problem of the present invention. Even in such a case, a configuration of the electrophotographic photosensitive member of the present invention can allow layer peeling-off to be suppressed.

(Electrophotographic Apparatus)

The electrophotographic apparatus of the present invention has the electrophotographic photosensitive member described above, and at least any member selected from the group consisting of a charging member and a developer carrying member. The electrophotographic apparatus may further have an exposing unit and/or a transfer unit.

Figure 2:
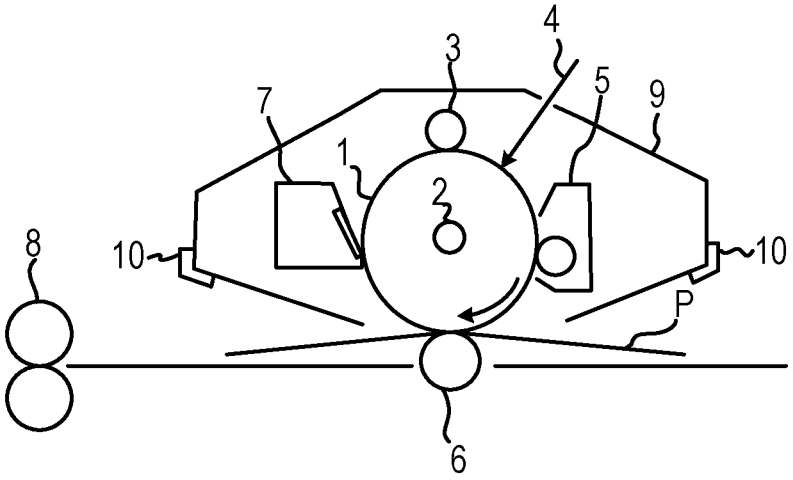
FIG. 2 is a view illustrating a schematic configuration of an electrophotographic apparatus having a process cartridge provided with the electrophotographic photosensitive member of the present invention.

FIG. 2 illustrates one example of a schematic configuration of an electrophotographic apparatus having a process cartridge provided with the electrophotographic photosensitive member.

In FIG. 2, a cylindrical electrophotographic photosensitive member 1 is rotatably driven at a predetermined peripheral velocity around a shaft 2 in the arrow direction. The surface (periphery) of the electrophotographic photosensitive member 1 rotatably driven is uniformly charged at a predetermined positive or negative potential by a charging unit 3 (primary charging unit: charging roller or the like). Then, the surface is exposed to exposure light (image exposure light) 4 from an exposing unit (not illustrated) such as slit exposure or laser beam scanning exposure. Thus, an electrostatic latent image corresponding to an intended image is sequentially formed on the surface of the electrophotographic photosensitive member 1.

The electrostatic latent image formed on the surface of the electrophotographic photosensitive member 1 is developed by a toner included in a developer of a developing unit 5 to form a toner image. Then, the toner image formed and carried on the surface of the electrophotographic photosensitive member 1 is sequentially transferred to a transfer material (paper or the like) P by a transfer bias from a transfer unit (transfer roller or the like) 6. Herein, the transfer material P is taken out from a transfer material feeding unit (not illustrated) and fed to a gap (abutting portion) between the electrophotographic photosensitive member 1 and the transfer unit 6 in synchronization with rotation of the electrophotographic photosensitive member 1.

The transfer material P to which the toner image is transferred is separated from the surface of the electrophotographic photosensitive member 1, introduced to a fixing unit 8 and subjected to image fixing, and conveyed as an image-formed product (print, copy) outside the apparatus.

The surface of the electrophotographic photosensitive member 1 after transfer of the toner image is subjected to removal of a transfer residual developer (toner) by a cleaning unit (cleaning blade or the like) 7, and cleaned. Then, the surface of the electrophotographic photosensitive member 1 is subjected to an antistatic treatment by pre-exposure light (not illustrated) from a pre-exposing unit (not illustrated), and thereafter repeatedly used for image formation. Herein, as illustrated in FIG. 2, when the charging unit 3 is a contact charging unit using a charging roller or the like, such pre-exposure light is not necessarily required.

Among elements including the electrophotographic photosensitive member 1, the charging unit 3, the developing unit 5, the transfer unit 6 and the cleaning unit 7, a plurality of elements can be selected and accommodated in a container to provide a process cartridge that integrally includes such elements bound. Thus, the process cartridge can be configured to be detachably attachable to the main body of an electrophotographic apparatus such as a copier or a laser beam printer. In FIG. 2, a cartridge that integrally supports the electrophotographic photosensitive member 1, the charging unit 3, the developing unit 5 and the cleaning unit 7 is formed. Then, the cartridge is designated as a process cartridge 9 that is detachably attachable to the main body of the electrophotographic apparatus by use of a guide unit 10 such as a rail for the main body of the electrophotographic apparatus. The abutting member in the present invention is mounted on the charging unit 3 (charging member), and a developer carrying unit of the developing unit 5, which feeds a developer to the electrophotographic photosensitive member, illustrated in FIG. 2. A relationship among the charging member or the developer carrying unit, the electrophotographic photosensitive member and the abutting member is illustrated in FIG. 3.

Figure 3:
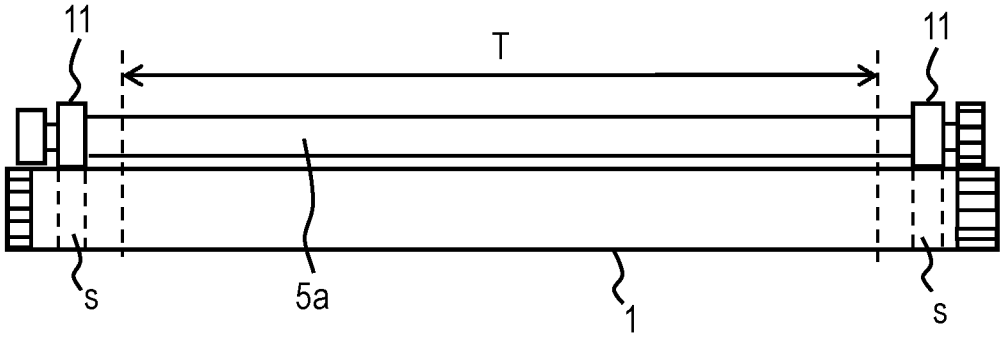
FIG. 3 is a view describing a relationship between the electrophotographic photosensitive member of the present invention and an abutting member.

FIG. 3 illustrates one example of a partial arrangement view of a process cartridge in which an abutting member 11 is provided on each of end portions of a charging member or developer carrying unit 5*a*. In FIG. 3, the abutting member 11 has a cylindrical shape, and the abutting member 11 is fitted into each of end portions in the axis direction of the charging member or developer carrying unit 5*a*. The abutting member 11 and the electrophotographic photosensitive member 1 are in contact with each other in an abutting region (also referred to as "projected area") S outside an image formation region T. Here, the electrophotographic photosensitive member 1 and the charging member or developer carrying unit 5*a* can be relatively rotated, and are subjected to a predetermined pressure and biased in the direction where the electrophotographic photosensitive member 1 and the charging member or developer carrying unit 5*a* come closer.

The photosensitive member is subjected to an abutting force from the abutting member, and largely damaged. Accordingly, in order to more exert the effect of the present invention, the abutting member abuts in a region of a photosensitive member having a layer configuration in which the charge generation layer is formed immediately above the intermediate layer or immediately above the undercoat layer represented by the above formula (3).

As one example, when the charging system is contact injection charging, a gap with the photosensitive member is required to be provided in order to perform rubbing of the surface of the photosensitive member by a charging brush or the like. When the charging system is non-contact charging, an increase in outer shape deflection accuracy is required in order that the charging roller uniformly performs charging of the photosensitive member. Examples include an abutting member to be used for such purposes. Even when the charging system is contact charging, an abutting member may be used in order to keep a constant abutting force with the surface of the photosensitive member. In addition, when the developing system is contact development, an abutting member is used because a developing roller is brought into contact with the photosensitive member and thus the degree of contact of the developing roller therewith is required to be modulated. When the developing system is non-contact development, the distance between a developing roller (sleeve) and the photosensitive member is very important, and an abutting member is used for such a purpose. The abutting member is sometimes referred to as a member that regulates the degree of approach of the developing roller.

EXAMPLES

Hereinafter, the present invention is described in more detail with reference to Examples and Comparative Examples. The present invention is not limited to the following Examples at all, unless departing from the gist thereof. In the following description of Examples, "part(s)" means part(s) by mass, unless particularly otherwise noted.

<1> Production of Electrophotographic Photosensitive Member (1) Preparation of Support (Support A)

An aluminum cylinder (JIS-A3003, aluminum alloy) having a length of 260.5 mm and a diameter of 30 mm was used as conductive support A.

(Support B)

An aluminum cylinder (JIS-A3003, aluminum alloy) having a length of 261.6 mm and a diameter of 24 mm was used as conductive support B.

(2) Preparation of Coating Liquid for Intermediate Layer (Coating Liquid A for Intermediate Layer)

A metal oxide particle: 214 parts of a titanium oxide particle covered with an oxygen-deficient type tin oxide (number average primary particle size: 200 nm), a phenol resin: 132 parts of Plyophen J-325 (produced by DIC Corporation), 40 parts of methanol and 58 parts of 1-methoxy-2-propanol were placed in a sand mill using 450 parts of glass beads having a diameter of 0.8 mm, and subjected to a dispersing treatment under conditions of a number of rotations of 2000 rpm, a dispersing treatment time of 4.5 hours and a set temperature of cooling water of 18° C. to provide a dispersion. The glass beads were removed from the dispersion by a mesh (aperture: 150 μm). Thereafter, a silicone oil SH28PA (produced by Dow Corning Toray Co., Ltd.) was added to the dispersion so that the amount thereof was 0.01% by mass based on the total content of the metal oxide particle and the phenol resin, and stirred to prepare coating liquid A for an intermediate layer.

(Coating Liquid B for Intermediate Layer)

Coating liquid B for an intermediate layer was prepared in the same manner as in (Coating liquid A for intermediate layer) except that a resin particle: Tospearl 120 (produced by Momentive Performance Materials Inc.) was further added so that the amount thereof was 5 parts based on the total content of the metal oxide particle and the phenol resin.

(Coating Liquid C for Intermediate Layer)

Coating liquid C for an intermediate layer was prepared in the same manner as in (coating liquid A for intermediate layer) except that a resin particle: Tospearl 120 (produced by Momentive Performance Materials Inc.) was further added so that the amount thereof was 10 parts based on the total content of the metal oxide particle and the phenol resin.

(Coating Liquid D for Intermediate Layer)

Coating liquid D for an intermediate layer was prepared in the same manner as in (Coating liquid C for intermediate layer) except that the amount of the metal oxide particle to be used was changed to 250 parts and the amount of the phenol resin to be used was changed to 90 parts.

(Coating Liquid E for Intermediate Layer)

Coating liquid E for an intermediate layer was prepared in the same manner as in (Coating liquid C for intermediate layer) except that the amount of the metal oxide particle to be used was changed to 300 parts and the amount of the phenol resin to be used was changed to 100 parts.

(Coating Liquid F for Intermediate Layer)

Coating liquid F for an intermediate layer was prepared in the same manner as in (Coating liquid C for intermediate layer) except that the amount of the metal oxide particle to be used was changed to 150 parts and the amount of the phenol resin to be used was changed to 150 parts.

(3) Preparation of Coating Liquid for Undercoat Layer

Each electron transporting material, each cross-linking agent and each resin, the types and amounts (part(s)) of which to be used were described in Table below, were dissolved together with 0.05 parts of zinc hexanoate (II) (produced by Mitsuwa Chemicals Co., Ltd.) as a catalyst in a mixed solvent of 50 parts of tetrahydrofuran and 50 parts of 1-methoxy-2-propanol, and stirred to thereby prepare each coating liquid for an undercoat layer.

In the Table, resin D1 represents a polyvinyl butyral resin having 2.5 mmol/g of a hydroxyl group (weight average molecular weight: 340,000); D2 represents a polyester resin having 2.1 mmol/g of a hydroxyl group (weight average molecular weight: 10,000); D3 represents a polyolefin resin having 2.8 mmol/g of a methoxy group (weight average molecular weight: 7,000); D4 represents a polyvinyl butyral resin having 3.3 mmol/g of a hydroxyl group (weight average molecular weight: 40,000); and D5 represents a polyvinyl butyral resin having 3.3 mmol/g of a hydroxyl group (weight average molecular weight: 100,000).

TABLE 1

Preparation conditions of coating liquid for undercoat layer

| | Electron transporting material | | Cross-linking agent | | Resin | |
|---|---|---|---|---|---|---|
| Coating liquid for undercoat layer | Type | Amount to be used (part(s)) | Type | Amount to be used (part(s)) | Type | Amount to be used (part(s)) |
| Coating liquid a-1 | A101 | 4.0 | B1(H5) | 5.5 | — | 0 |
| Coating liquid a-2 | A101 | 5.0 | B1(H1) | 4.5 | D1 | 0.5 |
| Coating liquid a-3 | A101 | 5.0 | B7(H5) | 5.0 | — | 0 |
| Coating liquid a-4 | A101 | 4.0 | C1-3 | 5.5 | D2 | 0.3 |
| Coating liquid a-5 | A101 | 4.0 | B1(H5) | 5.5 | D1 | 0.3 |
| Coating liquid b-1 | A104 | 4.5 | B15(H1) | 5.5 | D1 | 0.3 |
| Coating liquid b-2 | A104 | 5.0 | B1(H5) | 5.0 | — | 0 |
| Coating liquid c-1 | A117 | 5.0 | B1(H5) | 5.0 | — | 0 |
| Coating liquid c-2 | A117 | 4.5 | B1(H5) | 5.5 | D1 | 0.3 |
| Coating liquid c-3 | A117 | 5.0 | B1(H5) | 4.5 | D5 | 0.5 |
| Coating liquid c-4 | A117 | 4.5 | B1(H5) | 5.5 | D5 | 0.3 |
| Coating liquid c-5 | A117 | 4.5 | C2-4 | 5.5 | D3 | 0.3 |
| Coating liquid c-6 | A117 | 4.5 | B15(H1) | 5.5 | D1 | 0.3 |
| Coating liquid c-7 | A117 | 4.0 | C1-3 | 5.5 | D2 | 0.3 |
| Coating liquid d-1 | A203 | 4.5 | B1(H5) | 5.5 | D1 | 0.3 |
| Coating liquid d-2 | A203 | 5.0 | B1(H5) | 5.0 | — | 0 |
| Coating liquid e-1 | A302 | 4.5 | B1(H1) | 5.5 | D1 | 0.3 |
| Coating liquid e-2 | A302 | 5.0 | B7(H5) | 5.0 | — | 0 |
| Coating liquid e-3 | A302 | 5.0 | C1-7 | 4.5 | D4 | 0.5 |
| Coating liquid e-4 | A302 | 4.5 | B1(H5) | 5.5 | D2 | 0.3 |
| Coating liquid f-1 | A502 | 5.0 | B1(H5) | 5.0 | — | 0 |
| Coating liquid f-2 | A502 | 4.5 | B1(H5) | 5.5 | D1 | 0.3 |
| Coating liquid g-1 | A704 | 4.0 | B1(H5) | 5.5 | D1 | 0.3 |
| Coating liquid g-2 | A704 | 4.5 | B1(H5) | 5.5 | D1 | 0.3 |
| Coating liquid h | A802 | 5.0 | B1(H1) | 5.0 | — | 0 |
| Coating liquid i | A906 | 4.0 | B1(H5) | 5.5 | D1 | 0.3 |
| Coating liquid j | A1003 | 5.0 | B1(H5) | 4.5 | D1 | 0.5 |
| Coating liquid k | A1103 | 5.0 | B1(H5) | 4.5 | D1 | 0.5 |
| Coating liquid l | A1104 | 5.0 | B1(H5) | 4.5 | D1 | 0.5 |

(4) Preparation of Coating Liquid for Charge Generation Layer

Ten parts of a hydroxygallium phthalocyanine crystal (peak positions in X-ray diffraction pattern (Bragg angles: $2\theta \pm 0.2°$ using CuKα radiation: 7.5°, 9.9°, 12.5°, 16.3°, 18.6°, 25.1° and 28.3°) as the charge generating material, a polyacetal resin: 5 parts of S-LEC BX-1 (produced by Sekisui Chemical Co., Ltd.) and 250 parts of cyclohexanone were placed in a sand mill using glass beads having a diameter of 1 mm, and subjected to a dispersing treatment for 1.5 hours. Next, 250 parts of ethyl acetate was added thereto to thereby prepare a coating liquid for a charge generation layer.

(5) Preparation of Coating Liquid for Surface Layer

Seven parts of an amine compound represented by the following formula:

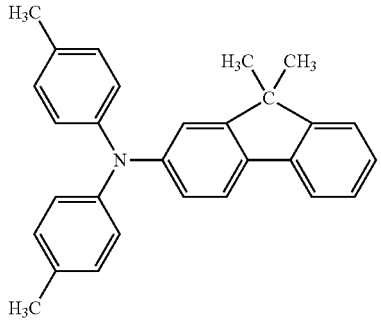

as the charge transporting material, and 10 parts of a polyester resin having respective structural units represented by the following two formulae (the molar ratio of the units derived from the respective formulae: 5:5, the weight average molecular weight: 120,000)

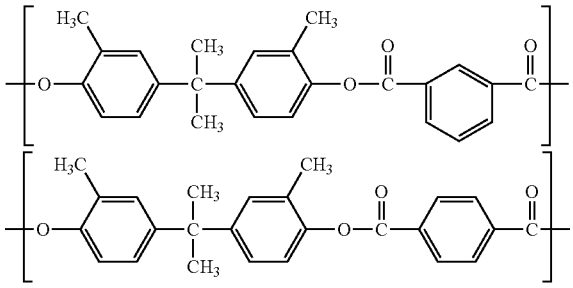

were dissolved in a mixed solvent of 50 parts of dimethoxymethane and 50 parts of O-xylene to thereby prepare a coating liquid for a surface layer.

(6) Production of Electrophotographic Photosensitive Member

Each electrophotographic photosensitive member was produced by the following method. Furthermore, with respect to the resulting photosensitive member, the average thickness of each layer, the Martens' hardness of the intermediate layer and the area of the undercoat layer present in a region in contact with an abutting member (the total area of the undercoat layer present in a region that could be in contact with the abutting member/the total area of the region that could be in contact with the abutting member) were measured by the above methods. The types and physical property values of the support and each of the coating liquids were shown in Table.

(6-1) Production of (B): Electrophotographic Photosensitive Members 1-1 to 1-82 in FIGS. 1A and 1B First, the support was dip-coated with the coating liquid for an intermediate layer, and the resulting coating film was dried under drying conditions described in Tables below and heat-cured to thereby form an intermediate layer. The ten-point average roughness $Rz_{JIS}$ (standard length: 0.8 mm) of the resulting intermediate layer at a position of 130 mm from one end of the support was measured using a surface roughness measuring instrument Surfcorder SE-3400 (manufactured by Kosaka Laboratory Ltd.). Furthermore, the amount of a hydroxyl group remaining on the surface of the intermediate layer was measured and calculated by the above method. In Tables, the value of $P_1/(P_2+P_3)$ obtained is shown.

Next, the support on which the intermediate layer was formed was dip-coated with the coating liquid for an undercoat layer, and the resulting coating film was heated at 160° C. for 60 minutes for polymerization, to thereby form an undercoat layer. In the dip-coating, a region within 15 mm from one end (upper portion in the dip-coating) of the support was not coated with the coating liquid for an undercoat layer, and a region within 15 mm from the other one end (lower portion in the dip-coating) thereof was dip-coated therewith, and thereafter wetted by a cyclohexanone solvent and scraped by a rubber blade to thereby peel a part or all of the undercoat layer.

Furthermore, the support on which the intermediate layer and the undercoat layer were formed was dip-coated with the coating liquid for a charge generation layer, and the resulting coating film was dried at 100° C. for 10 minutes to thereby form a charge generation layer. In the dip-coating, a region within 3 mm from one end (upper portion in the dip-coating) of the support was not coated with the coating liquid for a charge generation layer, and a region within 3 mm from the other one end (lower portion in the dip-coating) thereof was dip-coated therewith and thereafter subjected to wiping-off.

Finally, the support on which the intermediate layer, the undercoat layer and the charge generation layer were formed was dip-coated with the coating liquid for a surface layer, and the resulting coating film was dried at 120° C. for 20 minutes to thereby form a surface layer having an average thickness of 20 μm. In the dip-coating, a region within 3 mm from one end (upper portion in the dip-coating) of the support was not coated with the coating liquid for a surface layer, and a region within 3 mm from the other one end (lower portion in the dip-coating) thereof was dip-coated therewith and thereafter subjected to wiping-off.

TABLE 2

| Production conditions of photosensitive member | | | | | | | | | | | |
|---|---|---|---|---|---|---|---|---|---|---|---|
| | | Intermediate layer | | | | | Undercoat layer | | | Charge generation layer | |
| Photosensitive member No. | Support Type | Type of coating liquid | Drying conditions | Average thickness (μm) | $Rz_{JIS}$ (μm) | Amount of hydroxyl group remaining | Type of coating liquid | Area present (%) | Average thickness (μm) | Average thickness of first portion (μm) | Average thickness of second portion (μm) |
| Photosensitive member 1-1 | Support A | Coating liquid A | 60 min, 160° C. | 30.2 | 0.5 | 0.9 | Coating liquid a-1 | 0 | 0.5 | 0.15 | 0.15 |
| Photosensitive member 1-2 | Support A | Coating liquid A | 60 min, 160° C. | 25.1 | 0.8 | 0.9 | Coating liquid a-2 | 0 | 0.7 | 0.15 | 0.15 |
| Photosensitive member 1-3 | Support A | Coating liquid B | 60 min, 160° C. | 20.3 | 1.1 | 0.8 | Coating liquid c-1 | 0 | 0.7 | 0.15 | 0.15 |

TABLE 2-continued

| Production conditions of photosensitive member | | | | | | | | | | | |
|---|---|---|---|---|---|---|---|---|---|---|---|
| | | Intermediate layer | | | | | Undercoat layer | | | Charge generation layer | |
| Photosensitive member No. | Support Type | Type of coating liquid | Drying conditions | Average thickness (μm) | $Rz_{JIS}$ (μm) | Amount of hydroxyl group remaining | Type of coating liquid | Area present (%) | Average thickness (μm) | Average thickness of first portion (μm) | Average thickness of second portion (μm) |
| Photosensitive member 1-4 | Support A | Coating liquid B | 60 min, 160° C. | 12.2 | 1.9 | 0.8 | Coating liquid a-3 | 0 | 0.7 | 0.15 | 0.15 |
| Photosensitive member 1-5 | Support A | Coating liquid B | 60 min, 160° C. | 30.2 | 1.5 | 0.9 | Coating liquid c-2 | 0 | 0.8 | 0.15 | 0.15 |
| Photosensitive member 1-6 | Support A | Coating liquid C | 60 min, 160° C. | 15.1 | 2.4 | 0.8 | Coating liquid d-1 | 0 | 0.7 | 0.15 | 0.15 |
| Photosensitive member 1-7 | Support A | Coating liquid C | 60 min, 160° C. | 30.2 | 1.5 | 0.9 | Coating liquid e-1 | 0 | 0.6 | 0.15 | 0.15 |
| Photosensitive member 1-8 | Support A | Coating liquid C | 60 min, 160° C. | 30.2 | 1.5 | 0.9 | Coating liquid f-1 | 0 | 0.7 | 0.15 | 0.15 |
| Photosensitive member 1-9 | Support A | Coating liquid C | 60 min, 160° C. | 30.2 | 1.5 | 0.9 | Coating liquid g-1 | 0 | 0.7 | 0.15 | 0.15 |
| Photosensitive member 1-10 | Support A | Coating liquid C | 60 min, 160° C. | 30.2 | 1.3 | 1.3 | Coating liquid c-3 | 0 | 0.7 | 0.15 | 0.15 |
| Photosensitive member 1-11 | Support A | Coating liquid C | 20 min, 140° C. | 30.2 | 1.3 | 1.3 | Coating liquid c-4 | 0 | 0.8 | 0.15 | 0.15 |
| Photosensitive member 1-12 | Support A | Coating liquid C | 20 min, 140° C. | 30.2 | 1.3 | 1.3 | Coating liquid d-2 | 0 | 0.7 | 0.15 | 0.15 |
| Photosensitive member 1-13 | Support A | Coating liquid C | 20 min, 140° C. | 30.2 | 1.3 | 1.3 | Coating liquid e-2 | 0 | 0.7 | 0.15 | 0.15 |
| Photosensitive member 1-14 | Support A | Coating liquid C | 20 min, 140° C. | 30.2 | 1.3 | 1.3 | Coating liquid f-2 | 0 | 0.7 | 0.15 | 0.15 |
| Photosensitive member 1-15 | Support A | Coating liquid C | 20 min, 140° C. | 30.2 | 1.3 | 1.3 | Coating liquid g-2 | 0 | 0.6 | 0.15 | 0.15 |
| Photosensitive member 1-16 | Support A | Coating liquid C | 20 min, 140° C. | 30.2 | 1.3 | 1.3 | Coating liquid h | 0 | 0.7 | 0.15 | 0.15 |
| Photosensitive member 1-17 | Support A | Coating liquid C | 20 min, 140° C. | 30.2 | 1.3 | 1.3 | Coating liquid k | 0 | 0.7 | 0.15 | 0.15 |
| Photosensitive member 1-18 | Support A | Coating liquid C | 20 min, 140° C. | 30.2 | 1.3 | 1.3 | Coating liquid j | 0 | 0.7 | 0.15 | 0.15 |
| Photosensitive member 1-19 | Support A | Coating liquid C | 20 min, 140° C. | 30.2 | 1.3 | 1.3 | Coating liquid l | 0 | 0.7 | 0.15 | 0.15 |
| Photosensitive member 1-20 | Support A | Coating liquid C | 20 min, 140° C. | 15.2 | 2.1 | 1.2 | Coating liquid a-1 | 0 | 0.5 | 0.15 | 0.15 |
| Photosensitive member 1-21 | Support A | Coating liquid C | 20 min, 140° C. | 31.1 | 1.3 | 1.1 | Coating liquid c-2 | 0 | 0.6 | 0.15 | 0.15 |
| Photosensitive member 1-22 | Support A | Coating liquid C | 20 min, 140° C. | 31.2 | 1.3 | 1.1 | Coating liquid e-4 | 0 | 0.6 | 0.15 | 0.15 |
| Photosensitive member 1-23 | Support A | Coating liquid C | 20 min, 140° C. | 29.5 | 1.5 | 1.3 | Coating liquid h | 0 | 0.7 | 0.15 | 0.15 |
| Photosensitive member 1-24 | Support A | Coating liquid C | 20 min, 140° C. | 25.1 | 1.8 | 1.4 | Coating liquid c-2 | 0 | 0.6 | 0.15 | 0.15 |
| Photosensitive member 1-25 | Support A | Coating liquid C | 20 min, 140° C. | 30.2 | 1.3 | 1.2 | Coating liquid a-4 | 0 | 0.7 | 0.15 | 0.15 |
| Photosensitive member 1-26 | Support A | Coating liquid C | 20 min, 140° C. | 30.2 | 1.3 | 1.2 | Coating liquid c-5 | 0 | 0.6 | 0.15 | 0.15 |
| Photosensitive member 1-27 | Support A | Coating liquid C | 20 min, 140° C. | 30.2 | 1.3 | 1.2 | Coating liquid e-3 | 0 | 0.7 | 0.15 | 0.15 |
| Photosensitive member 1-28 | Support A | Coating liquid C | 20 min, 140° C. | 30.2 | 1.3 | 1.2 | Coating liquid c-6 | 0 | 0.6 | 0.15 | 0.15 |
| Photosensitive member 1-29 | Support A | Coating liquid C | 20 min, 140° C. | 29.8 | 1.4 | 1.2 | Coating liquid c-2 | 0 | 0.6 | 0.15 | 0.15 |
| Photosensitive member 1-30 | Support A | Coating liquid D | 20 min, 140° C. | 29.8 | 1.4 | 1.2 | Coating liquid c-7 | 0 | 0.7 | 0.15 | 0.15 |
| Photosensitive member 1-31 | Support A | Coating liquid E | 20 min, 140° C. | 29.8 | 1.4 | 1.2 | Coating liquid b-1 | 0 | 0.6 | 0.15 | 0.15 |
| Photosensitive member 1-32 | Support A | Coating liquid F | 20 min, 140° C. | 29.8 | 1.4 | 1.2 | Coating liquid c-1 | 0 | 0.7 | 0.15 | 0.15 |
| Photosensitive member 1-33 | Support A | Coating liquid D | 20 min, 140° C. | 29.8 | 1.4 | 1.2 | Coating liquid i | 0 | 0.7 | 0.15 | 0.15 |
| Photosensitive member 1-34 | Support A | Coating liquid D | 20 min, 140° C. | 29.8 | 1.4 | 1.2 | Coating liquid c-6 | 0 | 0.6 | 0.15 | 0.15 |
| Photosensitive member 1-35 | Support A | Coating liquid D | 20 min, 140° C. | 29.8 | 1.4 | 1.2 | Coating liquid e-4 | 0 | 0.6 | 0.15 | 0.15 |
| Photosensitive member 1-36 | Support A | Coating liquid D | 20 min, 140° C. | 29.8 | 1.4 | 1.2 | Coating liquid h | 0 | 0.7 | 0.15 | 0.15 |
| Photosensitive member 1-37 | Support A | Coating liquid D | 20 min, 140° C. | 29.8 | 1.4 | 1.2 | Coating liquid c-2 | 0 | 0.6 | 0.15 | 0.15 |
| Photosensitive member 1-38 | Support A | Coating liquid D | 20 min, 140° C. | 29.8 | 1.4 | 1.2 | Coating liquid a-4 | 0 | 0.7 | 0.15 | 0.15 |

TABLE 2-continued

| Production conditions of photosensitive member | | | | | | | | | | | |
|---|---|---|---|---|---|---|---|---|---|---|---|
| | | Intermediate layer | | | | | Undercoat layer | | | Charge generation layer | |
| Photosensitive member No. | Support Type | Type of coating liquid | Drying conditions | Average thickness (μm) | $Rz_{JIS}$ (μm) | Amount of hydroxyl group remaining | Type of coating liquid | Area present (%) | Average thickness (μm) | Average thickness of first portion (μm) | Average thickness of second portion (μm) |
| Photosensitive member 1-39 | Support A | Coating liquid D | 20 min, 140° C. | 29.8 | 1.4 | 1.2 | Coating liquid c-2 | 0 | 0.8 | 0.15 | 0.15 |
| Photosensitive member 1-40 | Support A | Coating liquid D | 20 min, 140° C. | 30.2 | 0.4 | 0.9 | Coating liquid a-5 | 0 | 0.7 | 0.15 | 0.15 |

TABLE 3

| Production conditions of photosensitive member | | | | | | | | | | | |
|---|---|---|---|---|---|---|---|---|---|---|---|
| | | Intermediate layer | | | | | Undercoat layer | | | Charge generation layer | |
| Photosensitive member No. | Support Type | Type of coating liquid | Drying conditions | Average thickness (μm) | $Rz_{JIS}$ (μm) | Amount of hydroxyl group remaining | Type of coating liquid | Area present (%) | Average thick-ness (μm) | Average thickness of first portion (μm) | Average thickness of second portion (μm) |
| Photosensitive member 1-41 | Support B | Coating liquid A | 60 min, 160° C. | 30.2 | 0.5 | 0.9 | Coating liquid a-1 | 0 | 0.7 | 0.15 | 0.15 |
| Photosensitive member 1-42 | Support B | Coating liquid A | 60 min, 160° C. | 25.1 | 0.8 | 0.9 | Coating liquid a-5 | 0 | 0.7 | 0.15 | 0.15 |
| Photosensitive member 1-43 | Support B | Coating liquid B | 60 min, 160° C. | 20.3 | 1.1 | 0.8 | Coating liquid a-1 | 0 | 0.7 | 0.15 | 0.15 |
| Photosensitive member 1-44 | Support B | Coating liquid B | 60 min, 160° C. | 12.2 | 1.9 | 0.8 | Coating liquid a-1 | 0 | 0.7 | 0.15 | 0.15 |
| Photosensitive member 1-45 | Support B | Coating liquid B | 60 min, 160° C. | 30.2 | 1.5 | 0.9 | Coating liquid a-2 | 0 | 0.7 | 0.15 | 0.15 |
| Photosensitive member 1-46 | Support B | Coating liquid C | 60 min, 160° C. | 15.1 | 2.4 | 0.8 | Coating liquid a-2 | 0 | 0.7 | 0.15 | 0.15 |
| Photosensitive member 1-47 | Support B | Coating liquid C | 20 min, 140° C. | 29.8 | 1.4 | 1.2 | Coating liquid c-2 | 0 | 0.6 | 0.15 | 0.15 |
| Photosensitive member 1-48 | Support B | Coating liquid D | 20 min, 140° C. | 29.8 | 1.4 | 1.2 | Coating liquid c-7 | 0 | 0.7 | 0.15 | 0.15 |
| Photosensitive member 1-49 | Support B | Coating liquid E | 20 min, 140° C. | 29.8 | 1.4 | 1.2 | Coating liquid b-1 | 0 | 0.6 | 0.15 | 0.15 |
| Photosensitive member 1-50 | Support B | Coating liquid F | 20 min, 140° C. | 29.8 | 1.4 | 1.2 | Coating liquid c-1 | 0 | 0.7 | 0.15 | 0.15 |
| Photosensitive member 1-51 | Support B | Coating liquid D | 20 min, 140° C. | 29.8 | 1.4 | 1.2 | Coating liquid i | 0 | 0.7 | 0.15 | 0.15 |
| Photosensitive member 1-52 | Support B | Coating liquid D | 20 min, 140° C. | 29.8 | 1.4 | 1.2 | Coating liquid c-6 | 0 | 0.6 | 0.15 | 0.15 |
| Photosensitive member 1-53 | Support B | Coating liquid D | 20 min, 140° C. | 29.8 | 1.4 | 1.2 | Coating liquid e-4 | 0 | 0.6 | 0.15 | 0.15 |
| Photosensitive member 1-54 | Support B | Coating liquid D | 20 min, 140° C. | 29.8 | 1.4 | 1.2 | Coating liquid h | 0 | 0.7 | 0.15 | 0.15 |
| Photosensitive member 1-55 | Support B | Coating liquid D | 20 min, 140° C. | 29.8 | 1.4 | 1.2 | Coating liquid c-2 | 0 | 0.6 | 0.15 | 0.15 |
| Photosensitive member 1-56 | Support B | Coating liquid D | 20 min, 140° C. | 29.8 | 1.4 | 1.2 | Coating liquid a-4 | 0 | 0.7 | 0.15 | 0.15 |
| Photosensitive member 1-57 | Support B | Coating liquid D | 20 min, 140° C. | 29.8 | 1.4 | 1.2 | Coating liquid c-2 | 0 | 0.8 | 0.15 | 0.15 |
| Photosensitive member 1-58 | Support B | Coating liquid D | 20 min, 140° C. | 15.2 | 2.1 | 1.0 | Coating liquid a-1 | 0 | 0.5 | 0.15 | 0.15 |
| Photosensitive member 1-59 | Support B | Coating liquid D | 20 min, 140° C. | 25.5 | 1.3 | 1.1 | Coating liquid c-2 | 0 | 0.6 | 0.15 | 0.15 |
| Photosensitive member 1-60 | Support B | Coating liquid E | 20 min, 140° C. | 28.5 | 1.3 | 1.1 | Coating liquid e-4 | 0 | 0.6 | 0.15 | 0.15 |
| Photosensitive member 1-61 | Support B | Coating liquid F | 20 min, 140° C. | 30.1 | 1.0 | 1.4 | Coating liquid h | 0 | 0.7 | 0.15 | 0.15 |
| Photosensitive member 1-62 | Support B | Coating liquid D | 20 min, 140° C. | 31.2 | 2.1 | 1.1 | Coating liquid c-2 | 0 | 0.6 | 0.15 | 0.15 |
| Photosensitive member 1-63 | Support B | Coating liquid D | 20 min, 140° C. | 29.8 | 1.4 | 1.2 | Coating liquid c-2 | 0 | 0.8 | 0.15 | 0.15 |

TABLE 3-continued

| Production conditions of photosensitive member | | | | | | | | | | | |
|---|---|---|---|---|---|---|---|---|---|---|---|
| | | Intermediate layer | | | | | Undercoat layer | | | Charge generation layer | |
| Photosensitive member No. | Support Type | Type of coating liquid | Drying conditions | Average thickness (μm) | $Rz_{JIS}$ (μm) | Amount of hydroxyl group remaining | Type of coating liquid | Area present (%) | Average thickness (μm) | Average thickness of first portion (μm) | Average thickness of second portion (μm) |
| Photosensitive member 1-64 | Support A | Coating liquid D | 20 min, 140° C. | 29.8 | 1.4 | 1.2 | Coating liquid c-2 | 0 | 0.8 | 0.15 | 0.05 (3 to 8 mm from upper end portion of support) |
| Photosensitive member 1-65 | Support A | Coating liquid D | 20 min, 140° C. | 31.2 | 2.1 | 1.1 | Coating liquid c-2 | 0 | 0.6 | 0.15 | 0.05 (7 to 12 mm from upper end portion of support) |
| Photosensitive member 1-66 | Support B | Coating liquid D | 20 min, 140° C. | 31.2 | 2.1 | 1.1 | Coating liquid c-2 | 0 | 0.6 | 0.15 | 0.05 (3 to 8 mm from upper end portion of support) |
| Photosensitive member 1-67 | Support B | Coating liquid D | 20 min, 140° C. | 31.2 | 2.1 | 1.1 | Coating liquid c-2 | 0 | 0.6 | 0.15 | 0.05 (7 to 12 mm from upper end portion of support) |
| Photosensitive member 1-68 | Support A | Coating liquid B | 60 min, 160° C. | 20.3 | 1.1 | 0.8 | Coating liquid c-1 | 80 | 0.7 | 0.15 | 0.15 |
| Photosensitive member 1-69 | Support A | Coating liquid B | 60 min, 160° C. | 20.3 | 1.1 | 0.8 | Coating liquid c-1 | 50 | 0.7 | 0.15 | 0.15 |
| Photosensitive member 1-70 | Support A | Coating liquid B | 60 min, 160° C. | 20.3 | 1.1 | 0.8 | Coating liquid c-1 | 10 | 0.7 | 0.15 | 0.15 |
| Photosensitive member 1-71 | Support A | Coating liquid B | 60 min, 160° C. | 20.3 | 1.1 | 0.8 | Coating liquid c-1 | 1 | 0.7 | 0.15 | 0.15 |
| Photosensitive member 1-72 | Support A | Coating liquid D | 20 min, 140° C. | 29.8 | 1.4 | 1.2 | Coating liquid c-2 | 1 | 0.8 | 0.15 | 0.15 |
| Photosensitive member 1-73 | Support A | Coating liquid A | 60 min, 160° C. | 30.2 | 0.4 | 0.9 | Coating liquid a-1 | 0 | 0.7 | 0.15 | 0.15 |
| Photosensitive member 1-74 | Support A | Coating liquid B | 60 min, 160° C. | 20.3 | 1.1 | 0.8 | Coating liquid b-2 | 0 | 0.7 | 0.15 | 0.15 |
| Photosensitive member 1-75 | Support A | Coating liquid C | 20 min, 140° C. | 29.8 | 1.4 | 1.2 | Coating liquid h | 0 | 0.7 | 0.15 | 0.15 |
| Photosensitive member 1-76 | Support A | Coating liquid C | 20 min, 140° C. | 29.8 | 1.4 | 1.2 | Coating liquid h | 0 | 0.7 | 0.15 | 0.15 |
| Photosensitive member 1-77 | Support A | Coating liquid C | 20 min, 140° C. | 29.8 | 1.4 | 1.2 | Coating liquid h | 0 | 0.7 | 0.15 | 0.15 |
| Photosensitive member 1-78 | Support B | Coating liquid A | 60 min, 160° C. | 30.2 | 0.4 | 0.9 | Coating liquid a-1 | 0 | 0.7 | 0.15 | 0.15 |
| Photosensitive member 1-79 | Support B | Coating liquid B | 60 min, 160° C. | 12.2 | 1.9 | 0.8 | Coating liquid a-3 | 0 | 0.7 | 0.15 | 0.15 |
| Photosensitive member 1-80 | Support B | Coating liquid C | 20 min, 140° C. | 15.2 | 2.1 | 1.0 | Coating liquid a-1 | 0 | 0.5 | 0.15 | 0.15 |
| Photosensitive member 1-81 | Support B | Coating liquid C | 20 min, 140° C. | 15.2 | 2.1 | 1.0 | Coating liquid a-1 | 0 | 0.5 | 0.15 | 0.15 |
| Photosensitive member 1-82 | Support B | Coating liquid C | 20 min, 140° C. | 15.2 | 2.1 | 1.0 | Coating liquid a-1 | 0 | 0.5 | 0.15 | 0.15 |

(Production of Electrophotographic Photosensitive Member 1-83)

Electrophotographic photosensitive member 1-83 was produced in the same manner as in production of electrophotographic photosensitive member 1-1 except for the following changes.

(1) The support was changed to an aluminum cylinder (JIS-A3003, aluminum alloy) having a length of 357.5 mm and a diameter of 30 mm.

(2) The region in which the intermediate layer was formed by dip-coating of the coating liquid for an intermediate layer was changed from the region within 15 mm to a region within 18 mm.

(3) The coating liquid for a surface layer was not used, and the following coating liquid for a charge transport layer and the following coating liquid for a surface protective layer were alternatively used to form a charge transport layer having a thickness of 18 μm and a surface protective layer having a thickness of 5 μm in this order.

The charge transport layer was formed by dip-coating of the following coating liquid for a charge transport layer, and drying of the resulting coating film at 110° C. for 60 minutes. In the dip-coating, a region within 3 mm from one end (upper portion in the dip-coating) of the support was not coated with the coating liquid for a charge transport layer, and a region within 3 mm from the other one end (lower portion in the dip-coating) thereof was dip-coated therewith and thereafter subjected to wiping-off.

As the coating liquid for a charge transport layer, a coating liquid was used which was obtained by dissolving 5 parts of both of two compounds represented by the following formulae, and a polycarbonate: 10 parts of Iupilon 2400 (produced by Mitsubishi Gas Chemical Company Inc.) in a mixed solvent of 650 parts of chlorobenzene and 150 parts of dimethoxymethane.

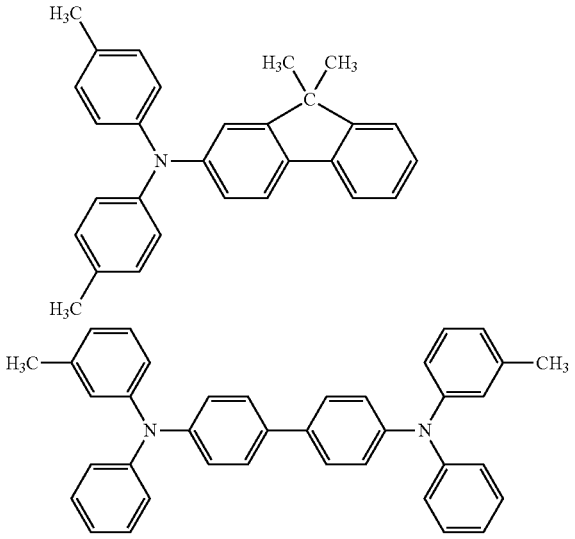

The surface protective layer was formed by the following procedure. First, dip-coating of the following coating liquid for a surface protective layer was performed and the resulting coating film was dried at 50° C. for 5 minutes. Thereafter, while the support was rotated in conditions of an acceleration voltage of 70 kV and an absorbed dose of 13000 Gy under a nitrogen atmosphere, the coating film was irradiated with an electron beam for 1.6 seconds and cured. Furthermore, a heating treatment was performed under a nitrogen atmosphere for 3 minutes in the following condition: the temperature of the coating film reached 120° C. Herein, the oxygen concentration during the period from the irradiation with an electron beam to the heating treatment was 20 ppm. Next, a heating treatment was performed in the atmosphere for 30 minutes in the following condition: the temperature of the coating film reached 100° C.; to form a surface protective layer.

As the coating liquid for a surface protective layer, a coating liquid was used which was obtained by dissolving 100 parts of a compound represented by the following formula in a mixed solvent of 1,1,2,2,3,3,4-heptafluorocyclopentane: 80 parts of Zeorora (manufactured by Zeon Corporation) and 80 parts of 1-propanol, and filtering the resultant by a polyflon filter: PF-020 (manufactured by Advantec Toyo Kaisha, Ltd.).

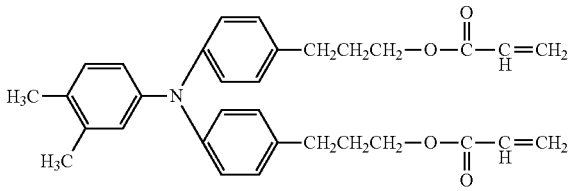

(4) After the surface protective layer was formed, a mold was used to form a surface shape on the surface of the photosensitive member. A dome-shaped mold having a convex shape, having a long axis diameter at the bottom of 50 μm, a gap of 8 μm and a height of 2.0 μm, was used as the mold, and while the temperatures of the surface of the photosensitive member and the mold were kept at 110° C. and the photosensitive member was rotated in the circumferential direction, the mold was pressurized to transfer the surface shape. Herein, the resulting surface of the photosensitive member was observed by a laser microscope VK-9500 (manufactured by Keyence Corporation), and it was found that a concave shape having a long axis diameter of 50 μm, a gap of 8 μm and a depth of 1.0 μm was formed.

(Production of Electrophotographic Photosensitive Member 1-84)

Electrophotographic photosensitive member 1-84 was produced in the same manner as in production of electrophotographic photosensitive member 1-83 except that the coating liquid in formation of the surface protective layer was changed to the following coating liquid for a surface protective layer and the absorbed dose of an electron beam was changed to 8500 Gy.

The coating liquid for a surface protective layer was prepared as follows. First, a fluorine-containing resin: 1.5 parts of GF-300 (produced by Toagosei Co., Ltd.) was dissolved in a mixed solvent of 1,1,2,2,3,3,4-heptafluorocyclopentane: 45 parts of Zeorora (manufactured by Zeon Corporation) and 45 parts of 1-propanol, and a tetrafluoroethylene resin powder: 30 parts of Lubron L-2 (produced by Daikin Industries, Ltd.) as a lubricant was added thereto to provide a solution. The solution was subjected to a treatment by a high-pressure dispersing machine: Microfluidizer M-110EH (manufactured by Microfluidics) at a pressure of 58.8 MPa (600 kgf/cm$^2$) four times and uniformly dispersed, and the resultant was filtered by a polyflon filter: PF-040 (manufactured by Advantec Toyo Kaisha, Ltd.) to prepare a dispersion. The dispersion was mixed with 70 parts of a compound represented by the following formula, 1,1,2,2,3,3,4-heptafluorocyclopentane: 35 parts of Zeorora (manufactured by Zeon Corporation) and 35 parts of 1-propanol, and the resultant was filtered by a polyflon filter: PF-020 (manufactured by Advantec Toyo Kaisha, Ltd.) to provide a coating liquid for a surface protective layer.

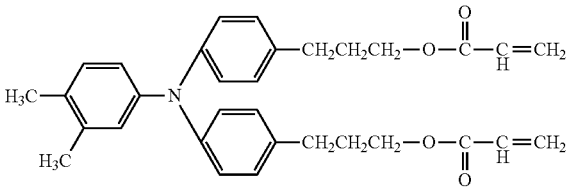

(6-2) Production of (A): Electrophotographic Photosensitive Members 2-1 to 2-72 in FIGS. 1A and 1B First, supports A and B were replaced with supports subjected to a honing treatment.

Next, any of the supports was dip-coated with the coating liquid for an undercoat layer, and the resulting coating film was heated at 160° C. for 60 minutes for polymerization, to thereby form an undercoat layer. In the dip-coating, a region within 15 mm from one end (upper portion in the dip-coating) of the support was not coated with the coating liquid for an undercoat layer, and a region within 15 mm from the other one end (lower portion in the dip-coating) thereof was dip-coated therewith, thereafter wetted by a cyclohexanone solvent and scraped by a rubber blade to thereby peel a part or all of the undercoat layer.

Next, a region within 15 mm from each of both ends of the support was dip-coated with the coating liquid for an intermediate layer, and the resulting coating film was dried and heat-cured at 160° C. for 60 minutes. The ten-point average roughness $Rz_{JIS}$ (standard length: 0.8 mm) of the resulting intermediate layer at a position of 130 mm from one end of the support, and the amount of a hydroxyl group remaining on the surface of the intermediate layer were measured and calculated by the above methods. The results are described in Tables of the evaluation results described below.

Furthermore, the support on which the intermediate layer and the undercoat layer were formed was dip-coated with the coating liquid for a charge generation layer, and the resulting coating film was dried at 100° C. for 10 minutes to thereby form a charge generation layer. In the dip-coating, a region within 3 mm from one end (upper portion in the dip-coating) of the support was not coated with the coating liquid for a charge generation layer, and a region within 3 mm from the other one end (lower portion in the dip-coating) thereof was dip-coated therewith and thereafter subjected to wiping-off.

Finally, the support on which the intermediate layer, the undercoat layer and the charge generation layer were formed was dip-coated with the coating liquid for a surface layer, and the resulting coating film was dried at 120° C. for 20 minutes to thereby form a surface layer. In the dip-coating, a region within 3 mm from one end (upper portion in the dip-coating) of the support was not coated with the coating liquid for a surface layer, and a region within 3 mm from the other one end (lower portion in the dip-coating) thereof was dip-coated therewith and thereafter subjected to wiping-off.

<2> Evaluation of Electrophotographic Photosensitive Member

The electrophotographic photosensitive member produced above was mounted on laser beam printer X or Y described below. Here, each of both end portions (upper and lower portions in dip-coating were referred to as "upper end portion" and "lower end portion", respectively) of the electrophotographic photosensitive member was allowed to abut with a gap holding member (cylindrical shape, made of polyoxymethylene) for holding a gap with a developer carrying member. The center position in the abutting was 9 mm from each of both end portions of the photosensitive member. Here, the image formation region of the electrophotographic photosensitive member was a region in the range from about 20 mm from the upper end portion, to about 20 mm from the lower end portion.

Laser beam printer X: HP LaserJet Enterprise 600 M603 (manufactured by HP Development Company, L.P.); non-contact development system, printing rate: 60 sheets (A4 longitudinal)/min, width of gap holding member: 4 mm Laser beam printer Y: HP LaserJet Enterprise 500 Color M551 (manufactured by HP Development Company, L.P.); contact development system, printing rate: 30 sheets (A4 longitudinal)/min, width of gap holding member: 2 mm Both the laser beam printers were altered so that the pressure (abutting force) to be applied from the gap holding member to each of the upper end portion and the lower end portion of the electrophotographic photosensitive member could be independently controlled.

Such a laser beam printer on which the electrophotographic photosensitive member was mounted was used to subject A4 size plane paper to image formation for 500,000 sheets under an environment of a temperature of 30° C. and a relative humidity of 90% in an intermittent mode where formation of an image having a printing rate of 1% was stopped every image formation for 2 sheets. The surface of a region of the electrophotographic photosensitive member, the region abutting with the gap holding member, was visually observed every 100,000 sheets, and the effect of suppressing layer peeling-off was evaluated. The evaluation criteria are as follows.

A: No changes were observed.

B: Slight peeling was observed.

C: Peeling was partially observed, but leading to no peeling-off.

D: Peeling-off was observed.

The types of the electrophotographic photosensitive member and the laser beam printer used, the abutting force applied to each of the upper end portion and the lower end portion of the photosensitive member, and the evaluation results were shown in Tables below.

TABLE 4

Evaluation conditions and evaluation results

| | | Evaluation conditions | | Evaluation results | | | | |
|---|---|---|---|---|---|---|---|---|
| Example No. | Photosensitive member No. | Type of printer (abutting width) | Abutting force on end portion (gf) | 100000 sheets | 200000 sheets | 300000 sheets | 400000 sheets | 500000 sheets |
| Example 1-1 | Photosensitive member 1-1 | X (4 mm) | 2300 | A | B | B | C | C |
| Example 1-2 | Photosensitive member 1-2 | X (4 mm) | 2300 | A | B | B | C | C |
| Example 1-3 | Photosensitive member 1-3 | X (4 mm) | 2300 | A | A | B | C | C |
| Example 1-4 | Photosensitive member 1-4 | X (4 mm) | 2300 | A | A | B | B | C |
| Example 1-5 | Photosensitive member 1-5 | X (4 mm) | 2300 | A | A | B | B | C |
| Example 1-6 | Photosensitive member 1-6 | X (4 mm) | 2300 | A | A | B | B | C |
| Example 1-7 | Photosensitive member 1-7 | X (4 mm) | 2300 | A | A | B | B | C |
| Example 1-8 | Photosensitive member 1-8 | X (4 mm) | 2300 | A | A | B | B | C |
| Example 1-9 | Photosensitive member 1-9 | X (4 mm) | 2300 | A | A | B | B | C |

TABLE 4-continued

| Evaluation conditions and evaluation results | | | | | | | | |
|---|---|---|---|---|---|---|---|---|
| | | Evaluation conditions | | Evaluation results | | | | |
| Example No. | Photosensitive member No. | Type of printer (abutting width) | Abutting force on end portion (gf) | 100000 sheets | 200000 sheets | 300000 sheets | 400000 sheets | 500000 sheets |
| Example 1-10 | Photosensitive member 1-10 | X (4 mm) | 2300 | A | A | B | B | C |
| Example 1-11 | Photosensitive member 1-11 | X (4 mm) | 2300 | A | A | A | A | A |
| Example 1-12 | Photosensitive member 1-12 | X (4 mm) | 2300 | A | A | A | A | A |
| Example 1-13 | Photosensitive member 1-13 | X (4 mm) | 2300 | A | A | A | A | B |
| Example 1-14 | Photosensitive member 1-14 | X (4 mm) | 2300 | A | A | A | A | B |
| Example 1-15 | Photosensitive member 1-15 | X (4 mm) | 2300 | A | A | A | A | A |
| Example 1-16 | Photosensitive member 1-16 | X (4 mm) | 2300 | A | A | A | A | A |
| Example 1-17 | Photosensitive member 1-17 | X (4 mm) | 2300 | A | A | A | A | A |
| Example 1-18 | Photosensitive member 1-18 | X (4 mm) | 2300 | A | A | A | A | A |
| Example 1-19 | Photosensitive member 1-19 | X (4 mm) | 2300 | A | A | A | A | A |
| Example 1-20 | Photosensitive member 1-20 | X (4 mm) | 2300 | A | A | A | A | A |
| Example 1-21 | Photosensitive member 1-21 | X (4 mm) | 2300 | A | A | A | A | A |
| Example 1-22 | Photosensitive member 1-22 | X (4 mm) | 2300 | A | A | A | A | A |
| Example 1-23 | Photosensitive member 1-23 | X (4 mm) | 2300 | A | A | A | A | B |
| Example 1-24 | Photosensitive member 1-24 | X (4 mm) | 2300 | A | A | A | A | B |
| Example 1-25 | Photosensitive member 1-25 | X (4 mm) | 2300 | A | A | A | A | A |
| Example 1-26 | Photosensitive member 1-26 | X (4 mm) | 2300 | A | A | A | A | A |
| Example 1-27 | Photosensitive member 1-27 | X (4 mm) | 2300 | A | A | A | A | A |
| Example 1-28 | Photosensitive member 1-28 | X (4 mm) | 2300 | A | A | A | A | B |
| Example 1-29 | Photosensitive member 1-29 | X (4 mm) | 2300 | A | A | A | A | B |
| Example 1-30 | Photosensitive member 1-30 | X (4 mm) | 2300 | A | A | A | A | B |
| Example 1-31 | Photosensitive member 1-31 | X (4 mm) | 2300 | A | A | A | A | B |
| Example 1-32 | Photosensitive member 1-32 | X (4 mm) | 2300 | A | A | A | A | A |
| Example 1-33 | Photosensitive member 1-33 | X (4 mm) | 2300 | A | A | A | A | A |
| Example 1-34 | Photosensitive member 1-34 | X (4 mm) | 2300 | A | A | A | A | B |
| Example 1-35 | Photosensitive member 1-35 | X (4 mm) | 2000 | A | A | A | A | A |
| Example 1-36 | Photosensitive member 1-36 | X (4 mm) | 2000 | A | A | A | A | A |
| Example 1-37 | Photosensitive member 1-37 | X (4 mm) | 2500 | A | A | A | B | B |
| Example 1-38 | Photosensitive member 1-38 | X (4 mm) | 2500 | A | A | A | B | B |
| Example 1-39 | Photosensitive member 1-39 | X (4 mm) | 2800 | A | A | B | B | B |
| Example 1-40 | Photosensitive member 1-40 | X (4 mm) | 2800 | A | B | B | B | B |

TABLE 5

| Evaluation conditions and evaluation results | | | | | | | | |
|---|---|---|---|---|---|---|---|---|
| | | Evaluation conditions | | | | | | |
| | | Type of printer | Abutting force on end | Evaluation results | | | | |
| Example No. | Photosensitive member No. | (abutting width) | portion (gf) | 100000 sheets | 200000 sheets | 300000 sheets | 400000 sheets | 500000 sheets |
| Example 1-41 | Photosensitive member 1-41 | Y (2 mm) | 1100 | A | B | B | C | C |
| Example 1-42 | Photosensitive member 1-42 | Y (2 mm) | 1100 | A | B | B | C | C |
| Example 1-43 | Photosensitive member 1-43 | Y (2 mm) | 1100 | A | A | B | C | C |
| Example 1-44 | Photosensitive member 1-44 | Y (2 mm) | 1100 | A | A | B | B | C |
| Example 1-45 | Photosensitive member 1-45 | Y (2 mm) | 1100 | A | A | B | B | C |
| Example 1-46 | Photosensitive member 1-46 | Y (2 mm) | 1100 | A | A | B | B | C |
| Example 1-47 | Photosensitive member 1-47 | Y (2 mm) | 1100 | A | A | B | B | C |
| Example 1-48 | Photosensitive member 1-48 | Y (2 mm) | 1100 | A | A | A | A | B |
| Example 1-49 | Photosensitive member 1-49 | Y (2 mm) | 1100 | A | A | A | B | B |
| Example 1-50 | Photosensitive member 1-50 | Y (2 mm) | 1100 | A | A | A | A | B |
| Example 1-51 | Photosensitive member 1-51 | Y (2 mm) | 1100 | A | A | A | A | A |
| Example 1-52 | Photosensitive member 1-52 | Y (2 mm) | 1100 | A | A | A | A | B |
| Example 1-53 | Photosensitive member 1-53 | Y (2 mm) | 900 | A | A | A | A | A |
| Example 1-54 | Photosensitive member 1-54 | Y (2 mm) | 900 | A | A | A | A | A |
| Example 1-55 | Photosensitive member 1-55 | Y (2 mm) | 1400 | A | A | A | B | B |
| Example 1-56 | Photosensitive member 1-56 | Y (2 mm) | 1400 | A | A | A | B | B |
| Example 1-57 | Photosensitive member 1-57 | Y (2 mm) | 1900 | A | A | B | B | B |
| Example 1-58 | Photosensitive member 1-58 | Y (2 mm) | 1900 | A | B | B | B | B |
| Example 1-59 | Photosensitive member 1-59 | Y (2 mm) | 1100 | A | B | B | B | C |
| Example 1-60 | Photosensitive member 1-60 | Y (2 mm) | 1100 | A | A | A | A | A |
| Example 1-61 | Photosensitive member 1-61 | Y (2 mm) | 1100 | A | A | A | B | B |
| Example 1-62 | Photosensitive member 1-62 | Y (2 mm) | 1100 | A | A | A | A | A |
| Example 1-63 | Photosensitive member 1-63 | Y (2 mm) | 1100 | A | A | A | A | B |
| Example 1-64 | Photosensitive member 1-64 | X (4 mm) | 2800 | A | B | B | B | B |
| Example 1-65 | Photosensitive member 1-65 | X (4 mm) | 2800 | A | B | B | B | B |
| Example 1-66 | Photosensitive member 1-66 | Y (2 mm) | 1100 | A | A | A | A | B |
| Example 1-67 | Photosensitive member 1-67 | Y (2 mm) | 1100 | A | A | A | A | B |
| Example 1-68 | Photosensitive member 1-68 | X (4 mm) | 2300 | A | B | C | C | C |
| Example 1-69 | Photosensitive member 1-69 | X (4 mm) | 2300 | A | A | B | C | C |
| Example 1-70 | Photosensitive member 1-70 | X (4 mm) | 2300 | A | A | B | B | C |
| Example 1-71 | Photosensitive member 1-71 | X (4 mm) | 2300 | A | A | B | B | C |
| Example 1-72 | Photosensitive member 1-72 | X (4 mm) | 2300 | A | A | B | B | C |
| Comparative Example 1-1 | Photosensitive member 1-73 | X (4 mm) | 2300 | C | D | D | D | D |
| Comparative Example 1-2 | Photosensitive member 1-74 | X (4 mm) | 2300 | B | C | C | D | D |

TABLE 5-continued

| Evaluation conditions and evaluation results | | | | | | | | |
|---|---|---|---|---|---|---|---|---|
| | | Evaluation conditions | | Evaluation results | | | | |
| Example No. | Photosensitive member No. | Type of printer (abutting width) | Abutting force on end portion (gf) | 100000 sheets | 200000 sheets | 300000 sheets | 400000 sheets | 500000 sheets |
| Comparative Example 1-3 | Photosensitive member 1-75 | X (4 mm) | 2300 | B | C | C | C | D |
| Comparative Example 1-4 | Photosensitive member 1-76 | X (4 mm) | 2000 | B | B | C | C | D |
| Comparative Example 1-5 | Photosensitive member 1-77 | X (4 mm) | 2500 | B | C | D | D | D |
| Comparative Example 1-6 | Photosensitive member 1-78 | Y (2 mm) | 1100 | C | D | D | D | D |
| Comparative Example 1-7 | Photosensitive member 1-79 | Y (2 mm) | 1100 | B | C | C | D | D |
| Comparative Example 1-8 | Photosensitive member 1-80 | Y (2 mm) | 1100 | B | C | C | C | D |
| Comparative Example 1-9 | Photosensitive member 1-81 | Y (2 mm) | 900 | B | B | C | C | D |
| Comparative Example 1-10 | Photosensitive member 1-82 | Y (2 mm) | 1400 | B | C | D | D | D |

TABLE 6

| Production conditions, evaluation conditions and evaluations results of photosensitive member | | | | | | | | | | | |
|---|---|---|---|---|---|---|---|---|---|---|---|
| | | Intermediate layer | | | Evaluation conditions | | Evaluation results | | | | |
| Example No. | Photosensitive member No. | Average thickness (μm) | $Rz_{JIS}$ (μm) | Amount of hydroxyl group remaining | Type of printer (abutting width) | Abutting force on end portion (gf) | 100000 sheets | 200000 sheets | 300000 sheets | 400000 sheets | 500000 sheets |
| Example 2-1 | Photosensitive member 2-1 | 4.2 | 0.5 | 0.9 | X (4 mm) | 2300 | A | B | B | C | C |
| Example 2-2 | Photosensitive member 2-2 | 3.1 | 0.8 | 0.9 | X (4 mm) | 2300 | A | B | B | C | C |
| Example 2-3 | Photosensitive member 2-3 | 2.3 | 1.1 | 0.8 | X (4 mm) | 2300 | A | A | B | C | C |
| Example 2-4 | Photosensitive member 2-4 | 1.2 | 1.9 | 0.8 | X (4 mm) | 2300 | A | A | B | B | C |
| Example 2-5 | Photosensitive member 2-5 | 4.2 | 1.5 | 0.9 | X (4 mm) | 2300 | A | A | B | B | C |
| Example 2-6 | Photosensitive member 2-6 | 2.1 | 2.4 | 0.8 | X (4 mm) | 2300 | A | A | B | B | C |
| Example 2-7 | Photosensitive member 2-7 | 4.2 | 1.5 | 0.9 | X (4 mm) | 2300 | A | A | B | B | C |
| Example 2-8 | Photosensitive member 2-8 | 4.2 | 1.5 | 0.9 | X (4 mm) | 2300 | A | A | B | B | C |
| Example 2-9 | Photosensitive member 2-9 | 4.2 | 1.5 | 0.9 | X (4 mm) | 2300 | A | A | B | B | C |
| Example 2-10 | Photosensitive member 2-10 | 4.2 | 1.3 | 1.3 | X (4 mm) | 2300 | A | A | B | B | C |
| Example 2-11 | Photosensitive member 2-11 | 4.2 | 1.3 | 1.3 | X (4 mm) | 2300 | A | A | A | A | A |
| Example 2-12 | Photosensitive member 2-12 | 4.2 | 1.3 | 1.3 | X (4 mm) | 2300 | A | A | A | A | A |
| Example 2-13 | Photosensitive member 2-13 | 4.2 | 1.3 | 1.3 | X (4 mm) | 2300 | A | A | A | A | B |
| Example 2-14 | Photosensitive member 2-14 | 4.2 | 1.3 | 1.3 | X (4 mm) | 2300 | A | A | A | A | B |
| Example 2-15 | Photosensitive member 2-15 | 4.2 | 1.3 | 1.3 | X (4 mm) | 2300 | A | A | A | A | A |
| Example 2-16 | Photosensitive member 2-16 | 4.2 | 1.3 | 1.3 | X (4 mm) | 2300 | A | A | A | A | A |
| Example 2-17 | Photosensitive member 2-17 | 4.2 | 1.3 | 1.3 | X (4 mm) | 2300 | A | A | A | A | A |
| Example 2-18 | Photosensitive member 2-18 | 4.2 | 1.3 | 1.3 | X (4 mm) | 2300 | A | A | A | A | A |

TABLE 6-continued

| Production conditions, evaluation conditions and evaluations results of photosensitive member | | | | | | | | | | | |
|---|---|---|---|---|---|---|---|---|---|---|---|
| | | Intermediate layer | | | Evaluation conditions | | | | | | |
| | | Average | | Amount of hydroxyl | Type of printer | Abutting force on end | Evaluation results | | | | |
| Example No. | Photosensitive member No. | thickness (μm) | $Rz_{JIS}$ (μm) | group remaining | (abutting width) | portion (gf) | 100000 sheets | 200000 sheets | 300000 sheets | 400000 sheets | 500000 sheets |
| Example 2-19 | Photosensitive member 2-19 | 4.2 | 1.3 | 1.3 | X (4 mm) | 2300 | A | A | A | A | A |
| Example 2-20 | Photosensitive member 2-20 | 1.2 | 2.1 | 1.2 | X (4 mm) | 2300 | A | A | A | A | A |
| Example 2-21 | Photosensitive member 2-21 | 4.5 | 1.3 | 1.1 | X (4 mm) | 2300 | A | A | A | A | A |
| Example 2-22 | Photosensitive member 2-22 | 4.5 | 1.3 | 1.1 | X (4 mm) | 2300 | A | A | A | A | A |
| Example 2-23 | Photosensitive member 2-23 | 4.0 | 1.5 | 1.3 | X (4 mm) | 2300 | A | A | A | A | B |
| Example 2-24 | Photosensitive member 2-24 | 3.2 | 1.8 | 1.4 | X (4 mm) | 2300 | A | A | A | A | B |
| Example 2-25 | Photosensitive member 2-25 | 4.2 | 1.3 | 1.2 | X (4 mm) | 2300 | A | A | A | A | A |
| Example 2-26 | Photosensitive member 2-26 | 4.2 | 1.3 | 1.2 | X (4 mm) | 2300 | A | A | A | A | A |
| Example 2-27 | Photosensitive member 2-27 | 4.2 | 1.3 | 1.2 | X (4 mm) | 2300 | A | A | A | A | A |
| Example 2-28 | Photosensitive member 2-28 | 4.2 | 1.3 | 1.2 | X (4 mm) | 2300 | A | A | A | A | B |
| Example 2-29 | Photosensitive member 2-29 | 4.1 | 1.4 | 1.2 | X (4 mm) | 2300 | A | A | A | A | B |
| Example 2-30 | Photosensitive member 2-30 | 4.1 | 1.4 | 1.2 | X (4 mm) | 2300 | A | A | A | A | B |
| Example 2-31 | Photosensitive member 2-31 | 4.1 | 1.4 | 1.2 | X (4 mm) | 2300 | A | A | A | A | B |
| Example 2-32 | Photosensitive member 2-32 | 4.1 | 1.4 | 1.2 | X (4 mm) | 2300 | A | A | A | A | A |
| Example 2-33 | Photosensitive member 2-33 | 4.1 | 1.4 | 1.2 | X (4 mm) | 2300 | A | A | A | A | A |
| Example 2-34 | Photosensitive member 2-34 | 4.1 | 1.4 | 1.2 | X (4 mm) | 2300 | A | A | A | A | B |
| Example 2-35 | Photosensitive member 2-35 | 4.1 | 1.4 | 1.2 | X (4 mm) | 2000 | A | A | A | A | A |
| Example 2-36 | Photosensitive member 2-36 | 4.1 | 1.4 | 1.2 | X (4 mm) | 2000 | A | A | A | A | A |
| Example 2-37 | Photosensitive member 2-37 | 4.1 | 1.4 | 1.2 | X (4 mm) | 2500 | A | A | A | B | B |
| Example 2-38 | Photosensitive member 2-38 | 4.1 | 1.4 | 1.2 | X (4 mm) | 2500 | A | A | A | B | B |
| Example 2-39 | Photosensitive member 2-39 | 4.1 | 1.4 | 1.2 | X (4 mm) | 2800 | A | A | B | B | B |
| Example 2-40 | Photosensitive member 2-40 | 4.2 | 0.4 | 0.9 | X (4 mm) | 2800 | A | B | B | B | B |

TABLE 7

| Production conditions, evaluation conditions and evaluation results of photosensitive member | | | | | | | | | | | |
|---|---|---|---|---|---|---|---|---|---|---|---|
| | | Intermediate layer | | | Evaluation conditions | | | | | | |
| | | Average | | Amount of hydroxyl | Type of printer | Abutting | Evaluation results | | | | |
| Example No. | Photosensitive member No. | thickness (μm) | $Rz_{JIS}$ (μm) | group remaining | (abutting width) | force on end portion (gf) | 100000 sheets | 200000 sheets | 300000 sheets | 400000 sheets | 500000 sheets |
| Example 2-41 | Photosensitive member 2-41 | 4.2 | 0.5 | 0.9 | Y (2 mm) | 1100 | A | B | B | C | C |
| Example 2-42 | Photosensitive member 2-42 | 3.1 | 0.8 | 0.9 | Y (2 mm) | 1100 | A | B | B | C | C |
| Example 2-43 | Photosensitive member 2-43 | 2.3 | 1.1 | 0.8 | Y (2 mm) | 1100 | A | A | B | C | C |
| Example 2-44 | Photosensitive member 2-44 | 1.2 | 1.9 | 0.8 | Y (2 mm) | 1100 | A | A | B | B | C |

TABLE 7-continued

| Production conditions, evaluation conditions and evaluation results of photosensitive member | | | | | | | | | | | |
|---|---|---|---|---|---|---|---|---|---|---|---|
| | | Intermediate layer | | | Evaluation conditions | | | | | | |
| | | Average | | Amount of hydroxyl | Type of printer | Abutting | Evaluation results | | | | |
| Example No. | Photosensitive member No. | thickness (μm) | $Rz_{JIS}$ (μm) | group remaining | (abutting width) | force on end portion (gf) | 100000 sheets | 200000 sheets | 300000 sheets | 400000 sheets | 500000 sheets |
| Example 2-45 | Photosensitive member 2-45 | 4.2 | 1.5 | 0.9 | Y (2 mm) | 1100 | A | A | B | B | C |
| Example 2-46 | Photosensitive member 2-46 | 1.5 | 2.4 | 0.8 | Y (2 mm) | 1100 | A | A | B | B | C |
| Example 2-47 | Photosensitive member 2-47 | 4.1 | 1.4 | 1.2 | Y (2 mm) | 1100 | A | A | B | B | C |
| Example 2-48 | Photosensitive member 2-48 | 4.1 | 1.4 | 1.2 | Y (2 mm) | 1100 | A | A | A | A | B |
| Example 2-49 | Photosensitive member 2-49 | 4.1 | 1.4 | 1.2 | Y (2 mm) | 1100 | A | A | A | B | B |
| Example 2-50 | Photosensitive member 2-50 | 4.1 | 1.4 | 1.2 | Y (2 mm) | 1100 | A | A | A | A | B |
| Example 2-51 | Photosensitive member 2-51 | 4.1 | 1.4 | 1.2 | Y (2 mm) | 1100 | A | A | A | A | A |
| Example 2-52 | Photosensitive member 2-52 | 4.1 | 1.4 | 1.2 | Y (2 mm) | 1100 | A | A | A | A | B |
| Example 2-53 | Photosensitive member 2-53 | 4.1 | 1.4 | 1.2 | Y (2 mm) | 900 | A | A | A | A | A |
| Example 2-54 | Photosensitive member 2-54 | 4.1 | 1.4 | 1.2 | Y (2 mm) | 900 | A | A | A | A | A |
| Example 2-55 | Photosensitive member 2-55 | 4.1 | 1.4 | 1.2 | Y (2 mm) | 1400 | A | A | A | B | B |
| Example 2-56 | Photosensitive member 2-56 | 4.1 | 1.4 | 1.2 | Y (2 mm) | 1400 | A | A | A | B | B |
| Example 2-57 | Photosensitive member 2-57 | 4.1 | 1.4 | 1.2 | Y (2 mm) | 1900 | A | A | B | B | B |
| Example 2-58 | Photosensitive member 2-58 | 1.5 | 2.1 | 1.0 | Y (2 mm) | 1900 | A | B | B | B | B |
| Example 2-59 | Photosensitive member 2-59 | 3.2 | 1.3 | 1.1 | Y (2 mm) | 1100 | A | B | B | B | C |
| Example 2-60 | Photosensitive member 2-60 | 4.0 | 1.3 | 1.1 | Y (2 mm) | 1100 | A | A | A | A | A |
| Example 2-61 | Photosensitive member 2-61 | 3.9 | 1.0 | 1.4 | Y (2 mm) | 1100 | A | A | A | B | B |
| Example 2-62 | Photosensitive member 2-62 | 4.5 | 2.1 | 1.1 | Y (2 mm) | 1100 | A | A | A | A | A |
| Example 2-63 | Photosensitive member 2-63 | 4.1 | 1.4 | 1.2 | Y (2 mm) | 1100 | A | A | A | A | B |
| Example 2-64 | Photosensitive member 2-64 | 4.1 | 1.4 | 1.2 | X (4 mm) | 2800 | A | B | B | B | B |
| Example 2-65 | Photosensitive member 2-65 | 4.2 | 2.1 | 1.1 | X (4 mm) | 2800 | A | B | B | B | B |
| Example 2-66 | Photosensitive member 2-66 | 4.2 | 2.1 | 1.1 | Y (2 mm) | 1100 | A | A | A | A | B |
| Example 2-67 | Photosensitive member 2-67 | 4.2 | 2.1 | 1.1 | Y (2 mm) | 1100 | A | A | A | A | B |
| Example 2-68 | Photosensitive member 2-68 | 2.3 | 1.1 | 0.8 | X (4 mm) | 2300 | A | B | C | C | C |
| Example 2-69 | Photosensitive member 2-69 | 2.3 | 1.1 | 0.8 | X (4 mm) | 2300 | A | A | B | C | C |
| Example 2-70 | Photosensitive member 2-70 | 2.3 | 1.1 | 0.8 | X (4 mm) | 2300 | A | A | B | B | C |
| Example 2-71 | Photosensitive member 2-71 | 2.3 | 1.1 | 0.8 | X (4 mm) | 2300 | A | A | B | B | C |
| Example 2-72 | Photosensitive member 2-72 | 3.8 | 1.4 | 1.2 | X (4 mm) | 2300 | A | A | B | B | C |

(Electrophotographic Photosensitive Members 1-83 and 1-84)

Each of electrophotographic photosensitive members 1-83 and 1-84 was mounted on a Bk station of a color copier: iR-ADV C5255 (manufactured by Canon Inc.) (two-component development system, printing rate: 55 sheets (A4 lateral)/min, width of end portion sealing member: 5 mm).

Here, an end portion sealing member for inhibiting a developer from being leaked was allowed to abut with each of both end portions of the electrophotographic photosensitive member. The center position in the abutting was 15 mm from each of both end portions of the photosensitive member. Evaluation was performed by the same evaluation methods and evaluation criteria as those described above.

As a result, the same evaluation results as in Example 1-1 were obtained in both of electrophotographic photosensitive members 1-83 and 1-84.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-266493, filed Dec. 26, 2014, Japanese Patent Application No. 2015-117435, filed Jun. 10, 2015 and Japanese Patent Application No. 2015-236559, filed Dec. 3, 2015, which are hereby incorporated by reference herein in their entirety.

What is claimed is:

1. An electrophotographic photosensitive member that abuts with at least any member selected from the group consisting of a charging member that charges the electrophotographic photosensitive member and a developer carrying member that feeds a developer to the electrophotographic photosensitive member, with an abutting member interposed therebetween, wherein the electrophotographic photosensitive member has a first portion and a second portion different from the first portion along the longitudinal direction thereof, and abuts with the abutting member on the second portion, the electrophotographic photosensitive member has a support, a charge generation layer comprising a charge generating material and a polyacetal resin, and a surface layer in this order, the electrophotographic photosensitive member has, in the first portion, an undercoat layer comprising a polymerized product of a composition comprising an electron transporting material and a cross-linking agent, the undercoat layer being adjacent to a surface of the charge generation layer, and the surface facing the support, and the electrophotographic photosensitive member has, in the second portion, an intermediate layer comprising a metal oxide particle and a phenol resin, the intermediate layer being between and adjacent to the support and the charge generation layer.

2. The electrophotographic photosensitive member according to claim 1, wherein the intermediate layer is continuously formed from in the second portion to in the first portion.

3. The electrophotographic photosensitive member according to claim 1, wherein a ten-point average roughness $Rz_{JIS}$ (standard length: 0.8 mm) of a surface of the intermediate layer according to JIS B 0601:2001 is 0.5 μm or more and 2.5 μm or less.

4. The electrophotographic photosensitive member according to claim 1, wherein an average thickness of the charge generation layer in the second portion of the electrophotographic photosensitive member is less than an average thickness of the charge generation layer in the first portion thereof.

5. A process cartridge detachably attachable to a main body of an electrophotographic apparatus, comprising an electrophotographic photosensitive member, and at least any member selected from the group consisting of a charging member that charges the electrophotographic photosensitive member and a developer carrying member that feeds a developer to the electrophotographic photosensitive member, the electrophotographic photosensitive member that abuts with at least any member selected from the group consisting of the charging member and the developer carrying member, with an abutting member interposed therebetween, wherein the electrophotographic photosensitive member has a first portion and a second portion different from the first portion along the longitudinal direction thereof, and abuts with the abutting member on the second portion, the electrophotographic photosensitive member has a support, a charge generation layer comprising a charge generating material and a polyacetal resin, and a surface layer in this order, the electrophotographic photosensitive member has, in the first portion, an undercoat layer comprising a polymerized product of a composition comprising an electron transporting material and a cross-linking agent, the undercoat layer being adjacent to a surface of the charge generation layer, and the surface facing the support, and the electrophotographic photosensitive member has, in the second portion, an intermediate layer comprising a metal oxide particle and a phenol resin, the intermediate layer being between and adjacent to the support and the charge generation layer.

6. An electrophotographic apparatus comprising an electrophotographic photosensitive member, and at least any member selected from the group consisting of a charging member that charges the electrophotographic photosensitive member and a developer carrying member that feeds a developer to the electrophotographic photosensitive member, the electrophotographic photosensitive member that abuts with at least any member selected from the group consisting of the charging member and the developer carrying member, with an abutting member interposed therebetween, wherein the electrophotographic photosensitive member has a first portion and a second portion different from the first portion along the longitudinal direction thereof, and abuts with the abutting member on the second portion, the electrophotographic photosensitive member has a support, a charge generation layer comprising a charge generating material and a polyacetal resin, and a surface layer in this order, the electrophotographic photosensitive member has, in the first portion, an undercoat layer comprising a polymerized product of a composition comprising an electron transporting material and a cross-linking agent, the undercoat layer being adjacent to a surface of the charge generation layer, and the surface facing the support, and the electrophotographic photosensitive member has, in the second portion, an intermediate layer comprising a metal oxide particle and a phenol resin, the intermediate layer being between and adjacent to the support and the charge generation layer.

* * * * *